US011289227B2

(12) United States Patent
Singh

(10) Patent No.: US 11,289,227 B2
(45) Date of Patent: Mar. 29, 2022

(54) SPENT NUCLEAR FUEL CANISTER

(71) Applicant: Holtec International, Camden, NJ (US)

(72) Inventor: Krishna P. Singh, Hobe Sound, FL (US)

(73) Assignee: HOLTEC INTERNATIONAL

( * ) Notice: Subject to any disclaimer, the term of this patent is extended or adjusted under 35 U.S.C. 154(b) by 368 days.

(21) Appl. No.: 16/695,450

(22) Filed: Nov. 26, 2019

(65) Prior Publication Data

US 2020/0176143 A1 Jun. 4, 2020

Related U.S. Application Data

(60) Provisional application No. 62/772,986, filed on Nov. 29, 2018.

(51) Int. Cl.

| | |
|---|---|
| ***G21F 5/008*** | (2006.01) |
| ***G21F 5/10*** | (2006.01) |
| ***G21F 5/12*** | (2006.01) |
| ***G21F 5/012*** | (2006.01) |

(52) U.S. Cl.

CPC ..... *G21F 5/008* (2013.01); *G21F 5/10* (2013.01); *G21F 5/12* (2013.01); *G21F 5/012* (2013.01)

(58) Field of Classification Search

CPC ..... G21F 5/008; G21F 5/005; G21F 5/012; G21F 5/00; G21F 5/06; G21F 5/065; G21F 5/08; G21F 5/10; G21F 5/12; G21F 5/40

USPC ..... 376/456, 272

See application file for complete search history.

(56) References Cited

U.S. PATENT DOCUMENTS

| | | | | |
|---|---|---|---|---|
| 3,111,586 | A * | 11/1963 | Rogers | G21F 5/008 250/507.1 |
| 3,997,078 | A * | 12/1976 | Melton | G21C 13/06 220/315 |
| 4,818,878 | A | 4/1989 | Popp et al. | |
| 4,983,352 | A * | 1/1991 | Efferding | G21F 5/012 376/250 |
| 5,061,858 | A | 10/1991 | Mallory | |
| 5,274,682 | A | 12/1993 | McDaniels, Jr. | |

(Continued)

OTHER PUBLICATIONS

International Search Report and Written Opinion for International Application No. PCT/US19/63174 dated Aug. 11, 2020.

*Primary Examiner* — Darlene M Ritchie

(74) *Attorney, Agent, or Firm* — The Belles Group, P.C.

(57) ABSTRACT

A canister for storing spent nuclear fuel includes an elongated shell, baseplate enclosing the bottom end of the shell, and removable top lid bolted to the shell. The shell may have a dual thickness comprising a lower portion with first thickness and upper portion with greater second thickness by comparison. The upper portion is formed by an annular boss defining a fastening portion of the shell including plural threaded bores for engaging the lid bolting. The fastening portion may protrude radially outwards or inwards in different embodiments. The lid has a mounting flange receiving the bolts and is seated on the top end of shell. The mounting flange does not protrude radially beyond the outer surface of the fastener portion to minimize the diameter of the canister for placement inside an outer radiation shielded overpack or cask for transport/storage. The shell may optionally include cooling fins.

23 Claims, 25 Drawing Sheets

(56) References Cited

U.S. PATENT DOCUMENTS

| | | | | |
|---|---|---|---|---|
| 5,887,042 | A * | 3/1999 | Akamatsu | G21F 5/00 376/272 |
| 6,195,404 | B1 * | 2/2001 | Lemogne | G21F 5/008 376/272 |
| 10,008,299 | B2 | 6/2018 | Wellwood et al. | |
| 2002/0118786 | A1 * | 8/2002 | Ohsono | G21F 5/012 376/272 |
| 2005/0117688 | A1 * | 6/2005 | Ohsono | G21F 5/10 376/272 |
| 2011/0150164 | A1 | 6/2011 | Singh et al. | |
| 2015/0069274 | A1 | 3/2015 | Agace | |
| 2015/0243390 | A1 | 8/2015 | Bracey et al. | |
| 2016/0012926 | A1 | 1/2016 | Lehnert et al. | |
| 2016/0196887 | A1 * | 7/2016 | Singh | G21F 9/36 220/592.01 |
| 2018/0005717 | A1 | 1/2018 | Singh et al. | |
| 2018/0322970 | A1 | 11/2018 | Singh et al. | |
| 2019/0304614 | A1 * | 10/2019 | Jeong | G21F 5/12 |

* cited by examiner

SPENT NUCLEAR FUEL CANISTER

CROSS-REFERENCE TO RELATED APPLICATIONS

This application claims the benefit of U.S. Provisional Application No. 62/772,986 filed Nov. 29, 2018, which is incorporated herein by reference in its entirety.

BACKGROUND

The present invention relates generally to systems for storing used or spent nuclear fuel, and more particularly to an improved nuclear fuel cask which forms part of the storage system.

In the operation of nuclear reactors, the nuclear energy source is in the form of hollow zircaloy tubes filled with enriched uranium, collectively arranged in multiple assemblages referred to as fuel assemblies. When the energy in the fuel assembly has been depleted to a certain predetermined level, the used or "spent" nuclear fuel (SNF) assemblies are removed from the nuclear reactor. The standard structure used to package used or spent fuel assemblies discharged from light water reactors for off-site shipment or on-site dry storage is known as the fuel basket. The fuel basket is essentially an assemblage of prismatic storage cells each of which is sized to store one fuel assembly that comprises a plurality of individual spent nuclear fuel rods. The fuel basket is arranged inside a cylindrical metallic storage canister (typically stainless steel), which is often referred to as a multi-purpose canister (MPC), which forms the primary containment. The canister is then placed into an outer ventilated overpack or cask, which forms the secondary containment, for safe transport and storage of the multiple spent fuel assemblies. The ventilation utilizes ambient cooling air to dissipate the considerable heat still emitted by the spent fuel.

The used or spent nuclear fuel contained in the fuel basket inside the fuel canister is stored in an inert gas atmosphere formed within the canister. Guaranteed sequestration of heat and radiation emitting used nuclear fuel from the environment under all storage or transport conditions is an essential design requirement for the canister. This assurance of confinement requirement has been fulfilled in the present state-of-the-art by hermetically seal welding the top lid to the canister shell after the spent fuel has been loaded into the canister (typically under water such as in the spent fuel pool of a nuclear reactor). The all-welded canister provides guaranteed confinement of the contents, but makes the stored fuel difficult-to-access if repackaging is required at a later date. While lid cutting tools to sever the lid from the canister shell have been successfully developed and demonstrated, the cutting operation is inherently dose-accretive, cumbersome, and time-consuming requiring metal chip and lubricant management during the process.

Improvements in the traditional spent nuclear fuel canisters which overcomes the foregoing deficiencies are desired.

BRIEF SUMMARY

To overcome the foregoing limitations in the art for retrieving the spent nuclear fuel (SNF) contents from "all-welded" fuel canister constructions presently used in the nuclear industry, a new and improved spent nuclear fuel canister is disclosed herein which not only maintains the essential features of the canister's structural ruggedness for protecting the fuel, but also makes the fuel more readily accessible without the foregoing cutting process, and with minimum human effort and radiation exposure to the workers. Some embodiments further include heat dissipation features for significantly increasing the heat rejection capability of the canisters, thereby safeguarding the structural integrity of the SNF stored therein. Also importantly, the SNF canisters disclosed herein advantageously maintain the same preferred small dimensions and profile (i.e. height and diameter) of prior canisters with seal welded lids, thereby allowing the new canisters to be used interchangeably in existing outer transport and storage overpacks or casks without modification.

The SNF canister according to the present disclosure includes a multi-thickness shell and compact bolted closure lid-to-shell joint for ready access to the fuel contents inside. This eliminates the time-consuming and cumbersome prior cutting processes described above which are required to sever a welded joint between the lid and shell in welded lid designs. In one embodiment, the present lid may be directly bolted to the top of the shell.

To accommodate the bolting and seals required, a multi-thickness shell is provided having a top fastening portion that comprises a reinforcement structure in the form of an annular mounting boss integrally formed with the shell. The top fastening portion of the shell has a greater transverse wall thickness than the wall portion of the shell below, thereby providing additional purchase for engaging the bolts at the bolted lid joint. In some embodiments, the mounting boss may have a wall thickness equal to or greater than at least twice the thickness of the lower shell wall.

In various embodiments described herein, the upper annular mounting boss may protrude radially inwards into the cavity of the shell beyond its lower inner surface, or alternatively protrude radially outwards beyond the lower outer surface of the shell. The boss or fastening portion of the shell comprises a plurality circumferentially spaced and upwardly open threaded bores formed in the top of the shell at the fastening portion. The bores threadably engage the bolts which extend longitudinally through the lid. An inner and outer seal are provided to seal the containment cavity of the SNF canister and provide redundant high integrity leak barriers.

In some preferred embodiments, the top mounting boss/fastening portion may be formed as a monolithic unitary structural portion of the shell which may be one piece. In other embodiments, the mounting boss/fastening portion may be a discrete element seal welded to the lower smaller thickness portion of the shell.

The closure lid has an annular mounting flange receiving the through bolts. The flange is seated on the top end of canister shell. Significantly, the mounting flange does not protrude radially beyond the outer surface of the either the upper fastening portion or lower portions shell to minimize the outside diameter of the canister necessary for storing the canister inside the an outer radiation shielded overpack or cask for transport/storage. This unique lid and bolting construction and arrangement advantageously results in a compact lid design, thereby keeping the outer cask's outside diameter to the smallest possible which is an essential part of a design that complies with the NRC's 10CFR71 regulations. Although bolted lids may be used in the bulker radiation shielded outer transport/storage casks, such bulkier designs are not suit for the inner SNF canister which must maintain the smallest outer diameter and profile possible without substantially reducing the number of spent fuel assemblies which be storage inside the canister.

In one embodiment, the canister may further comprise a plurality of radial cooling fins arranged perimetrically on the outer surface of the shell to enhance heat dissipation. The fins may be welded directly to the outer surface of the shell or may be integrally formed therewith to provide direct contact. This ensures an effective conductive heat transfer path from the shell to the outer environment surrounding the canister, thereby allowing the fins to act as heat radiators. In some constructions, the fins may be disposed in an annular 360 degree recessed lower area of the outer shell formed by the mounting boss. By locating the fins in the recessed area below the mounting boss, the fins advantageously do not protrude radially outwards beyond the lid, shell, and bottom baseplate of the canister in some implementations to maintain the desired small outside diameter of the canister package, and importantly to protect the fins from damage when handling and moving the canister during the spent fuel dewaters, staging, and transport operations.

In one aspect, a canister for spent nuclear fuel storage comprises: a longitudinal axis; an elongated shell extending along the longitudinal axis, the shell including a top end and a bottom end; a cavity extending along the longitudinal axis inside the shell for storing spent nuclear fuel; a baseplate attached to the bottom end of shell and enclosing a lower portion of the cavity; a closure lid detachably fastened to the top end of the shell and enclosing an upper portion of the cavity; and a plurality of mounting bolts extending longitudinally through the lid and threadably engaging the top end of the shell; wherein the canister is configured for placement inside an outer overpack with radiation shielding.

In another aspect, a canister for spent nuclear fuel storage comprises: a vertical longitudinal axis; a cylindrical shell extending along the longitudinal axis, the shell including a top end, a bottom end, and an outer surface; an internal cavity extending between the top end and bottom end of the shell along the longitudinal axis for storing spent nuclear fuel; a baseplate attached to the bottom end of the shell and enclosing a lower portion of the cavity; a closure lid detachably fastened to the top end of the shell and enclosing an upper portion of the cavity, the lid having a circular body comprising a first portion and a second mounting flange portion protruding radially outwards beyond the first portion; and a plurality of mounting bolts extending longitudinally through the mounting portion of the lid and threadably engaging the top end of the shell; wherein the mounting flange portion of the lid does not protrude radially outwards beyond the outer surface of the shell; wherein the canister is configured for placement inside an outer overpack with radiation shielding.

In another aspect, a canister for spent nuclear fuel storage comprises: a vertical longitudinal axis; a cylindrical shell extending along the longitudinal axis, the shell including a top end and a bottom end; a cavity extending along the longitudinal axis inside the shell for storing spent nuclear fuel; a baseplate attached to the bottom end of shell and enclosing a lower portion of the cavity; a closure lid detachably fastened to the top end of the shell and enclosing an upper portion of the cavity; and a plurality of mounting bolts extending longitudinally through the lid and threadably engaging the top end of the shell; and a plurality of longitudinally-extending cooling fins protruding radially outwards from the shell, the fins spaced perimetrically apart around the shell; wherein an outer surface of the lid is substantially flush with an outer surface of the top end of the shell; wherein the canister is configured for placement inside an outer overpack with radiation shielding.

A system for storing spent nuclear fuel comprises: a longitudinal axis; an elongated outer cask comprising a double-walled first shell including a radiation shielding material, a first lid attached to a top end of the first shell, and an internal first cavity; an elongated inner cylinder canister positioned in the first cavity of the first shell, the cylinder comprising: a single-walled second shell extending along the longitudinal axis, the second shell including a top end and a bottom end; a second cavity extending along the longitudinal axis inside the second shell, the second cavity containing spent nuclear fuel; a baseplate attached to the bottom end of shell and enclosing a lower portion of the second cavity; a second lid detachably fastened to the top end of the second shell and enclosing an upper portion of the second cavity; and a plurality of mounting bolts extending longitudinally through the second lid and threadably engaging a plurality of blind threaded bores formed the top end of the second shell; the threaded bores formed in a radially projecting mounting boss extending circumferentially around the top end of the second shell, the mounting boss having a greater transverse first wall thickness than a transverse second wall thickness of lower portions of the second shell below the mounting boss.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein like elements are labeled similarly and in which.

Figure 1:
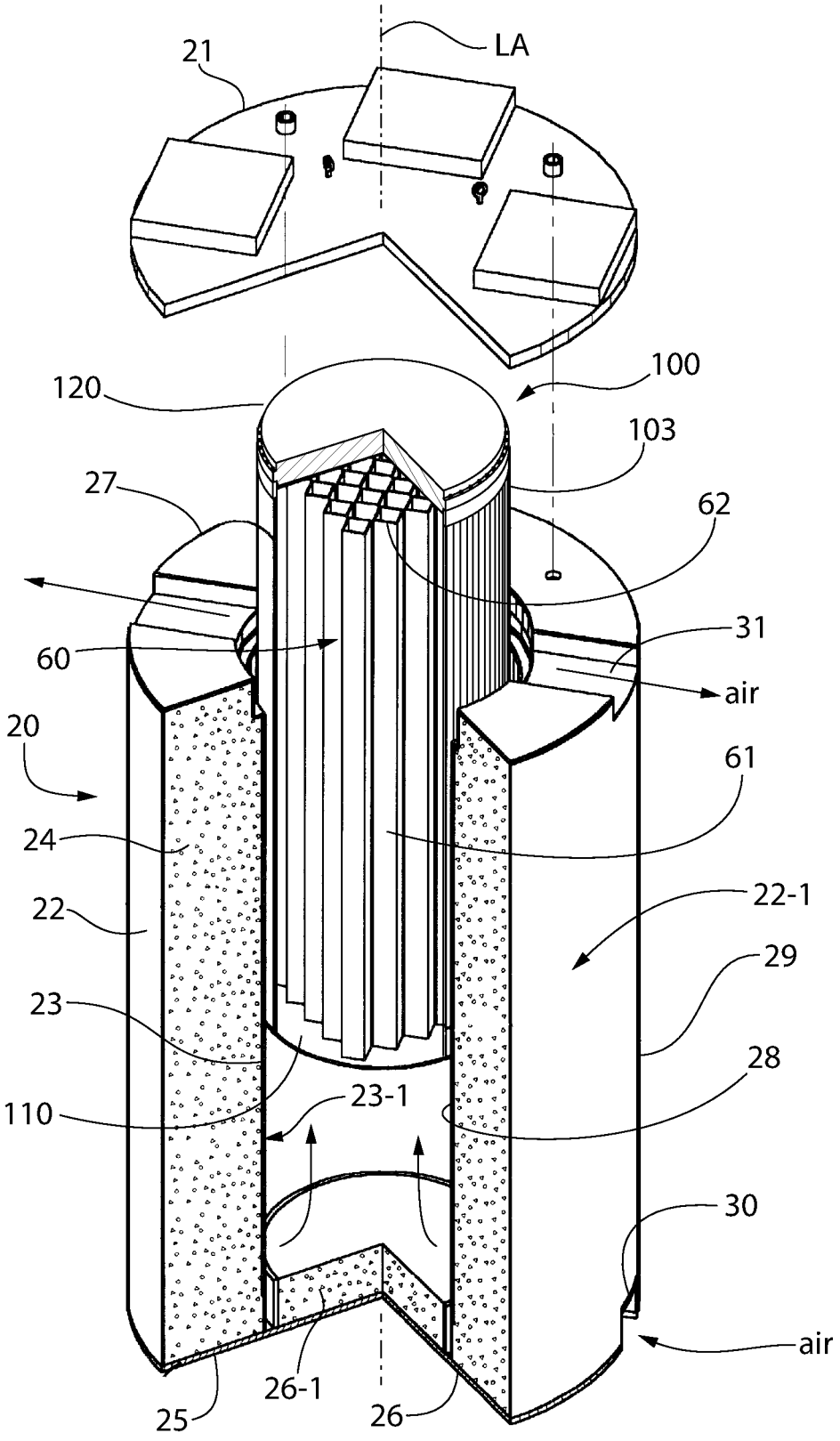
FIG. 1 is a partial cross-sectional perspective view of a cask and canister system for the storage and transport of spent nuclear fuel according to the present disclosure.
Figure 2:
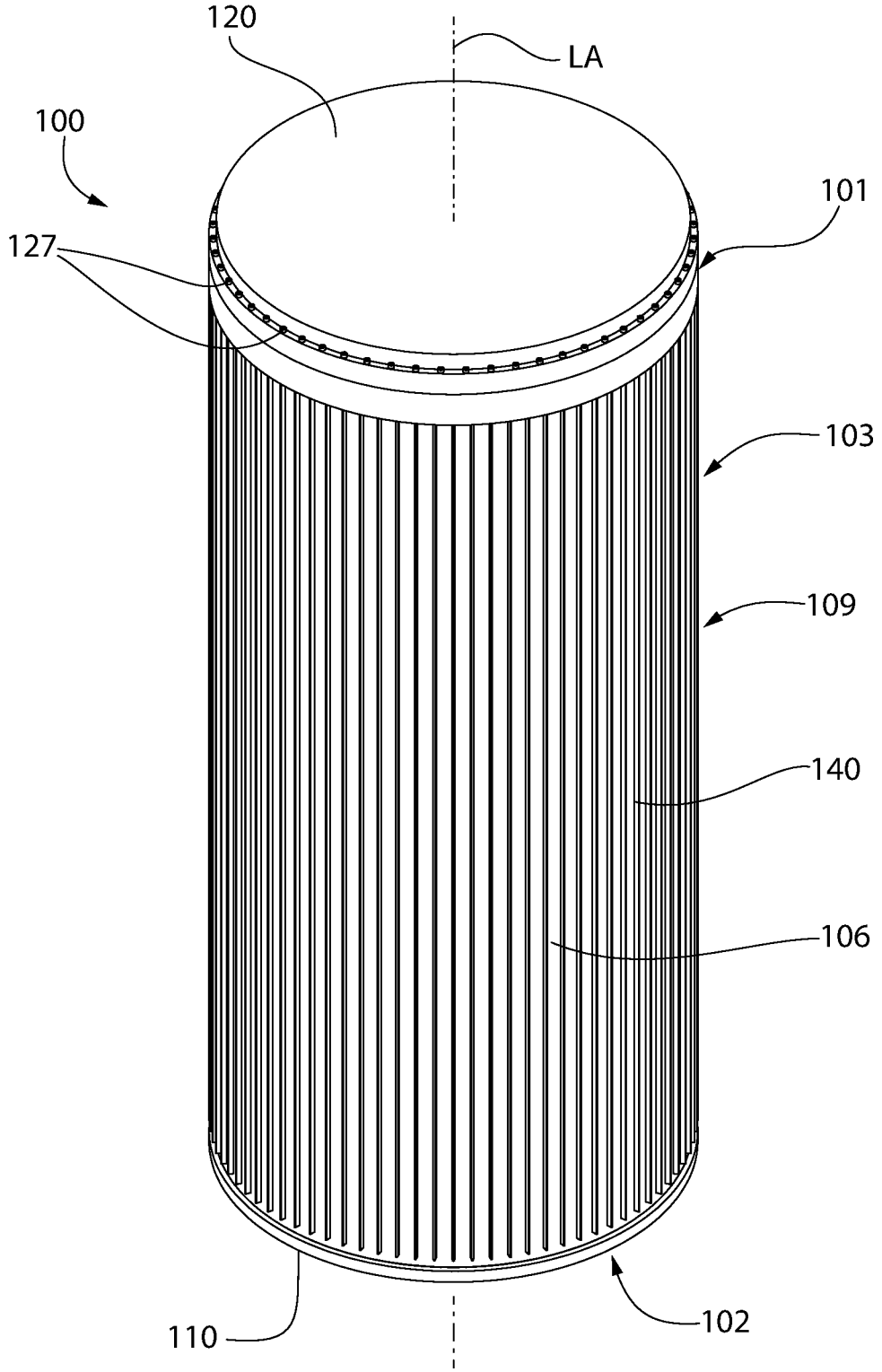
FIG. 2 is a top perspective view of the canister and bolted lid thereof.
Figure 3:
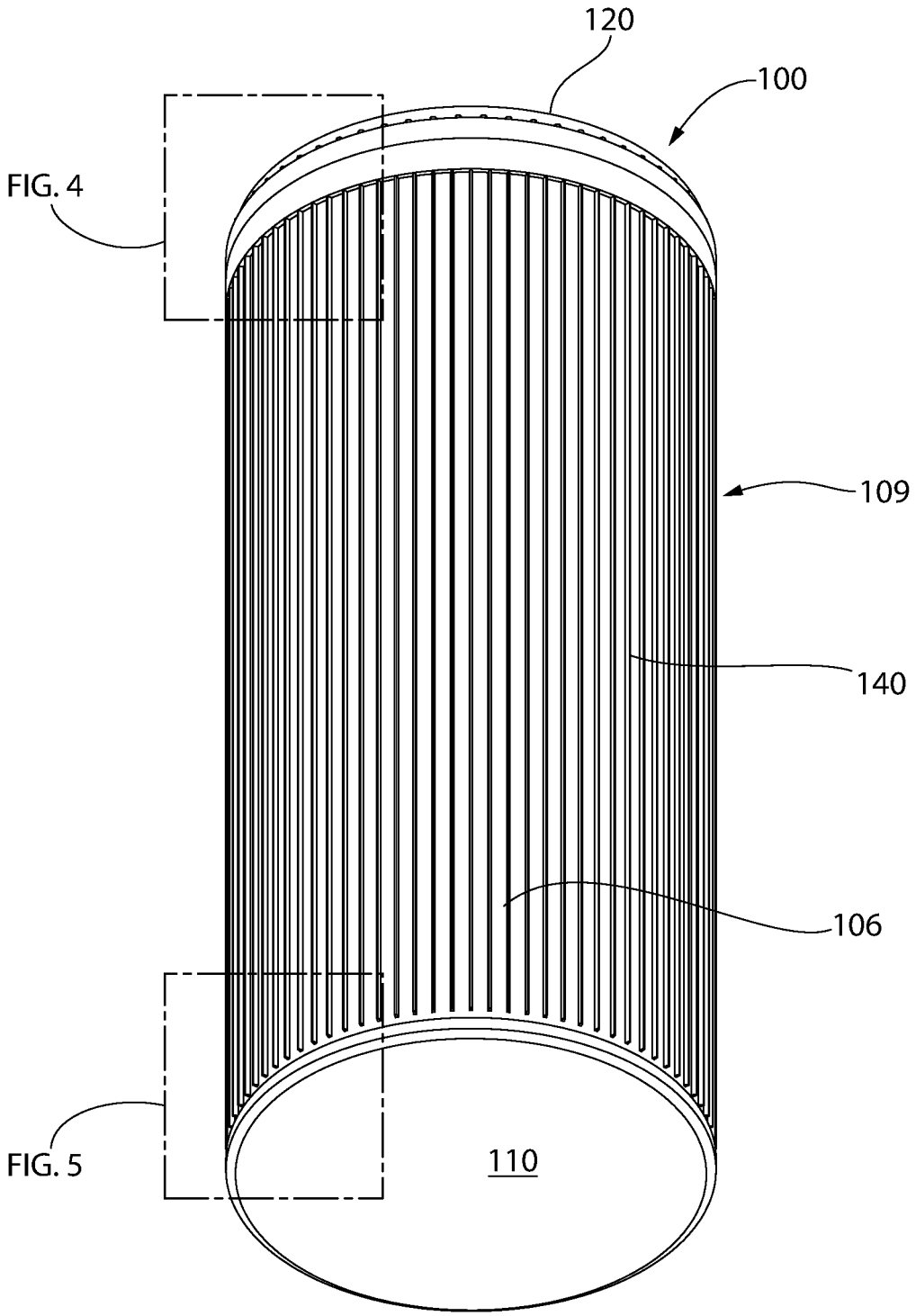
FIG. 3 is a bottom perspective view thereof.
Figure 4:
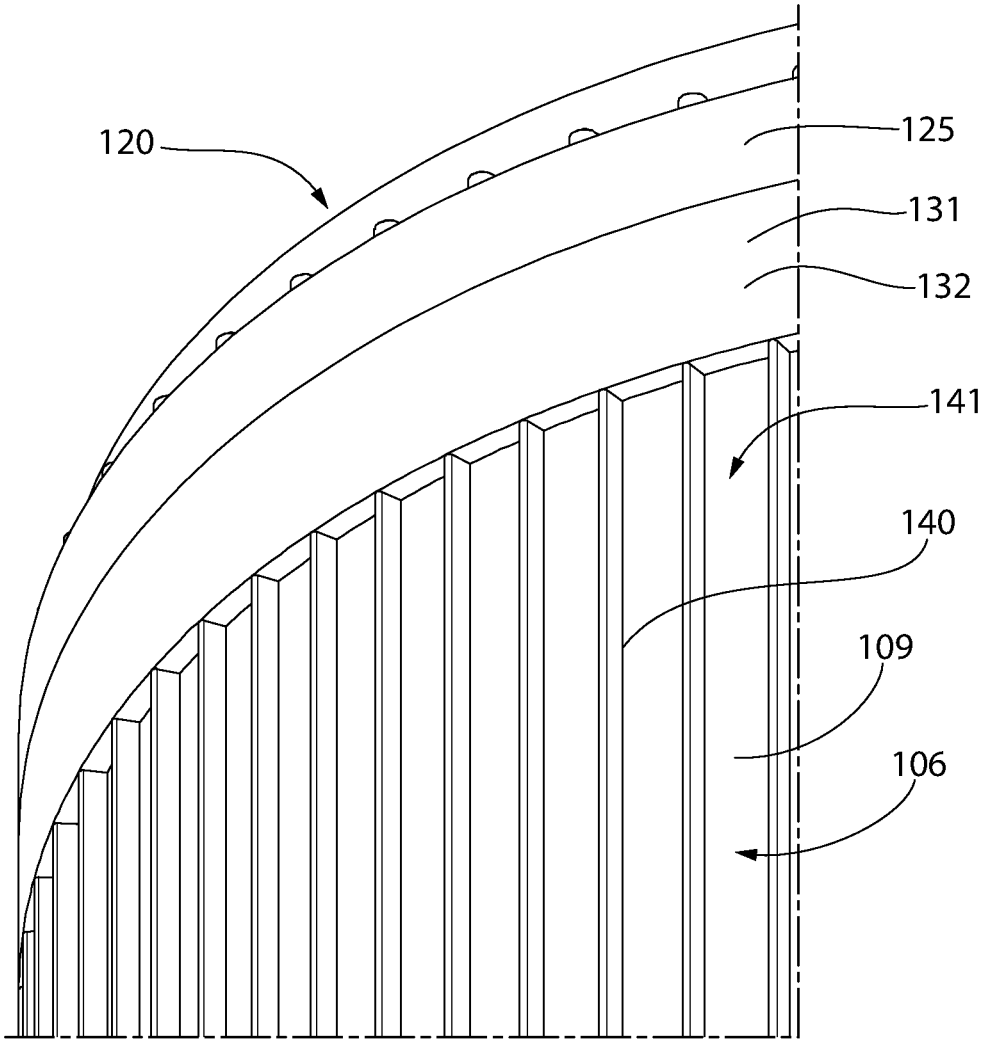
FIG. 4 is a first detail view from FIG. 3.
Figure 5:
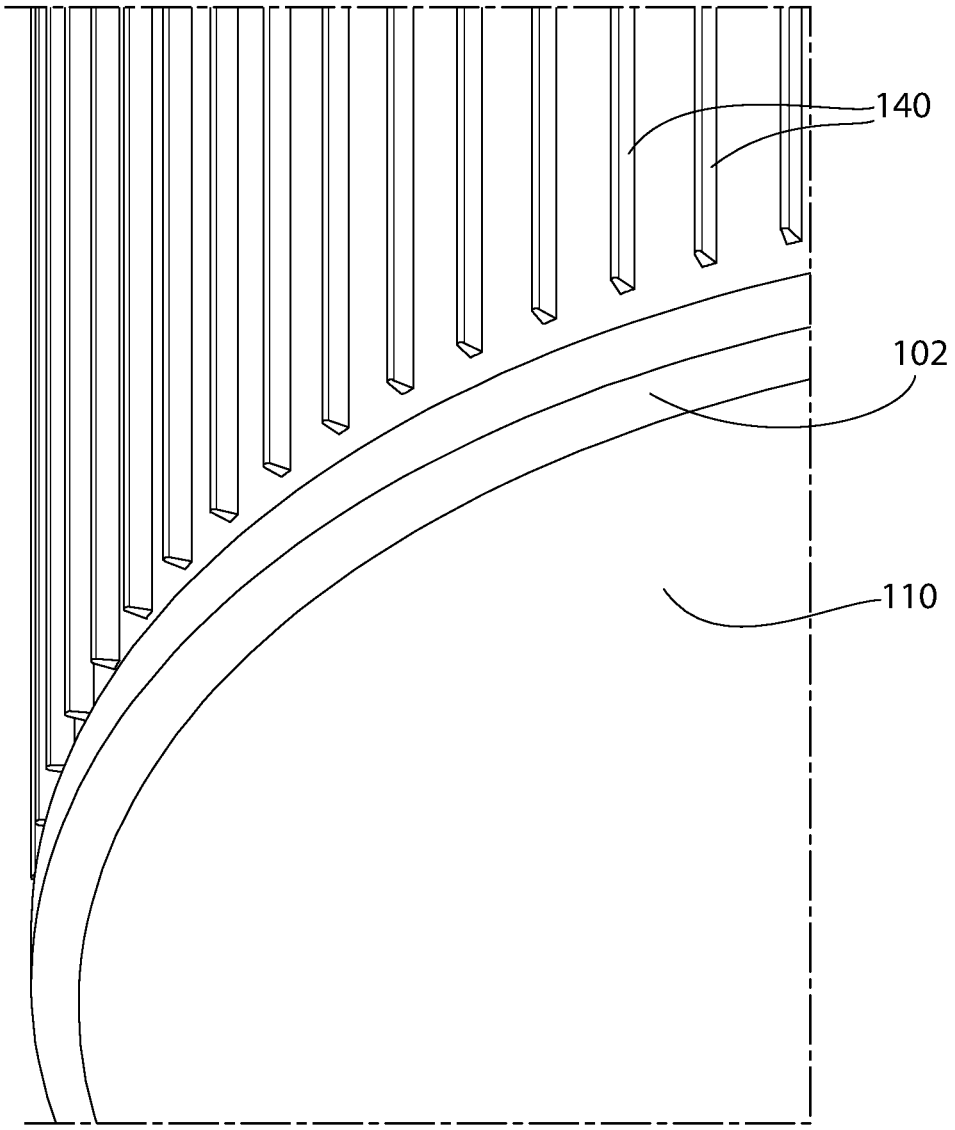
FIG. 5 is a second detail view from FIG. 3.
Figure 6:
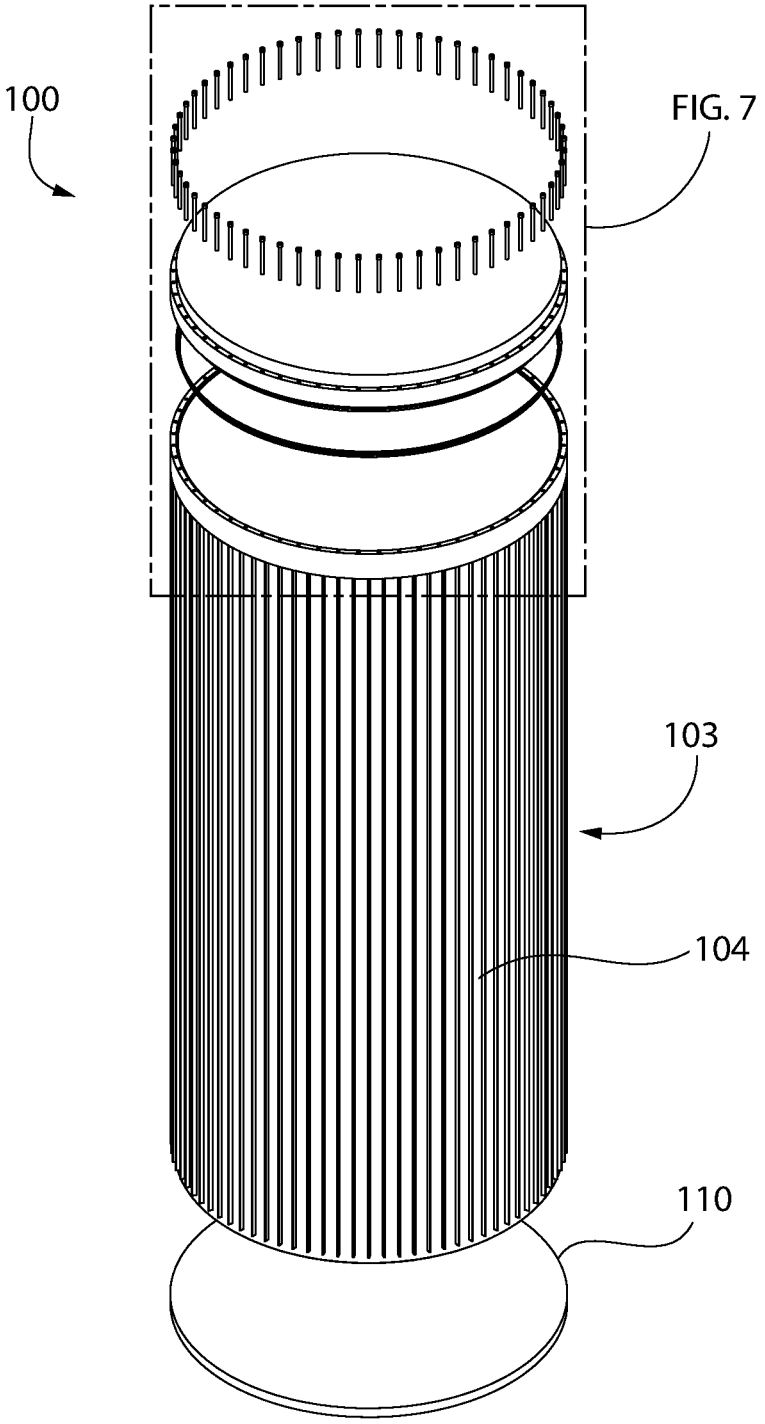
FIG. 6 is an exploded perspective view of the canister.
Figure 7:
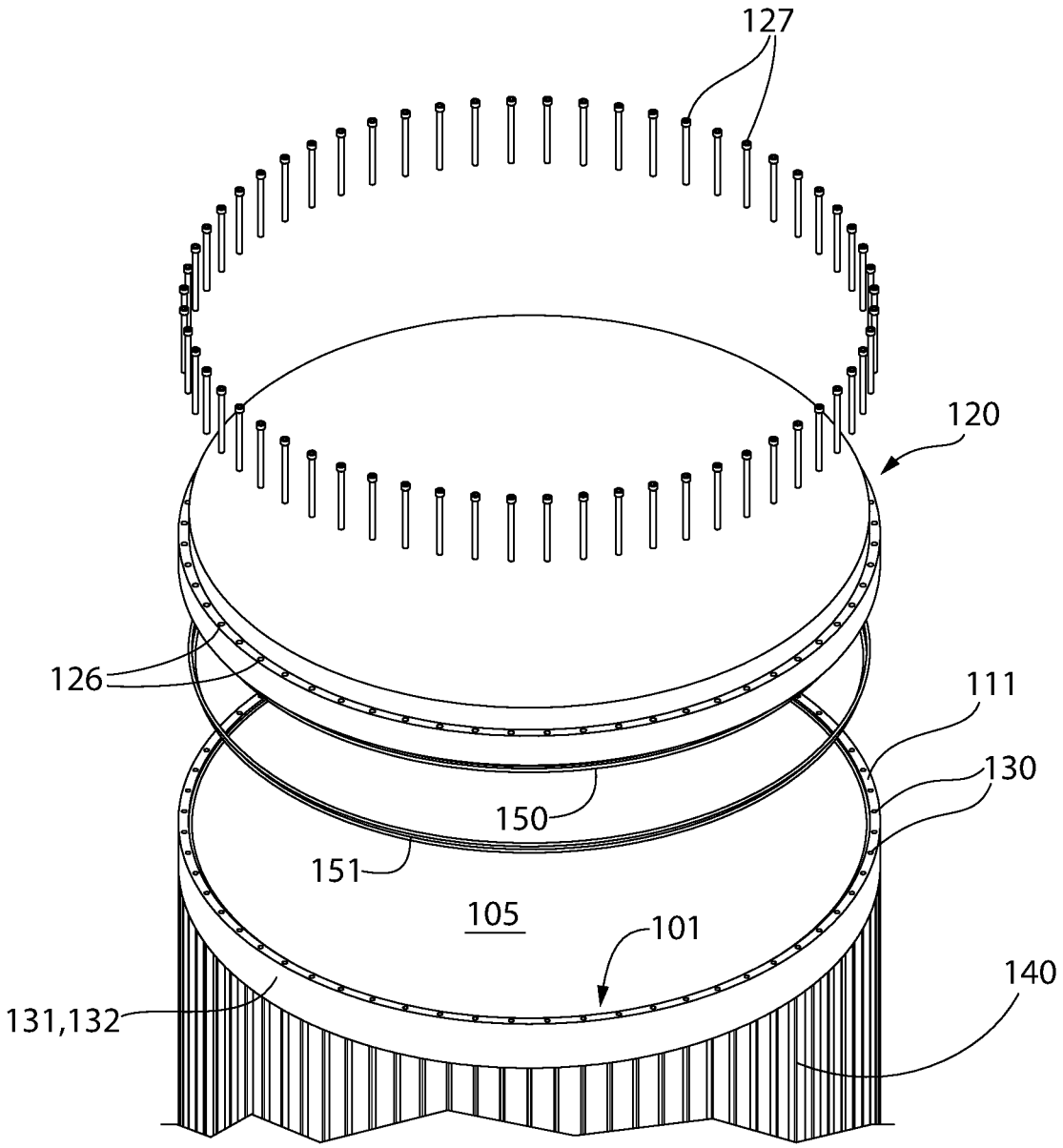
FIG. 7 is a detail view from FIG. 6.
Figure 8:
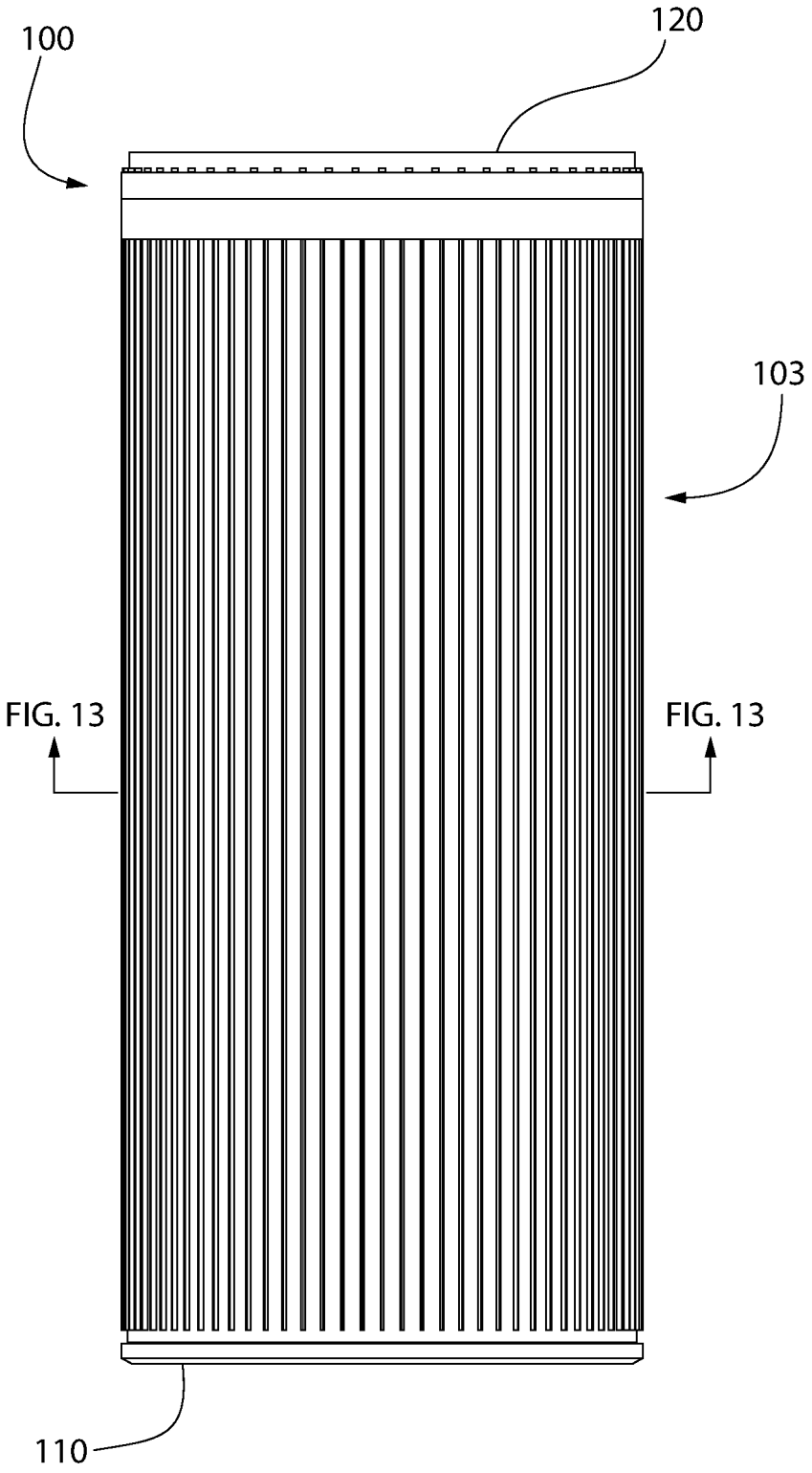
FIG. 8 is a side view of the canister.
Figure 9:
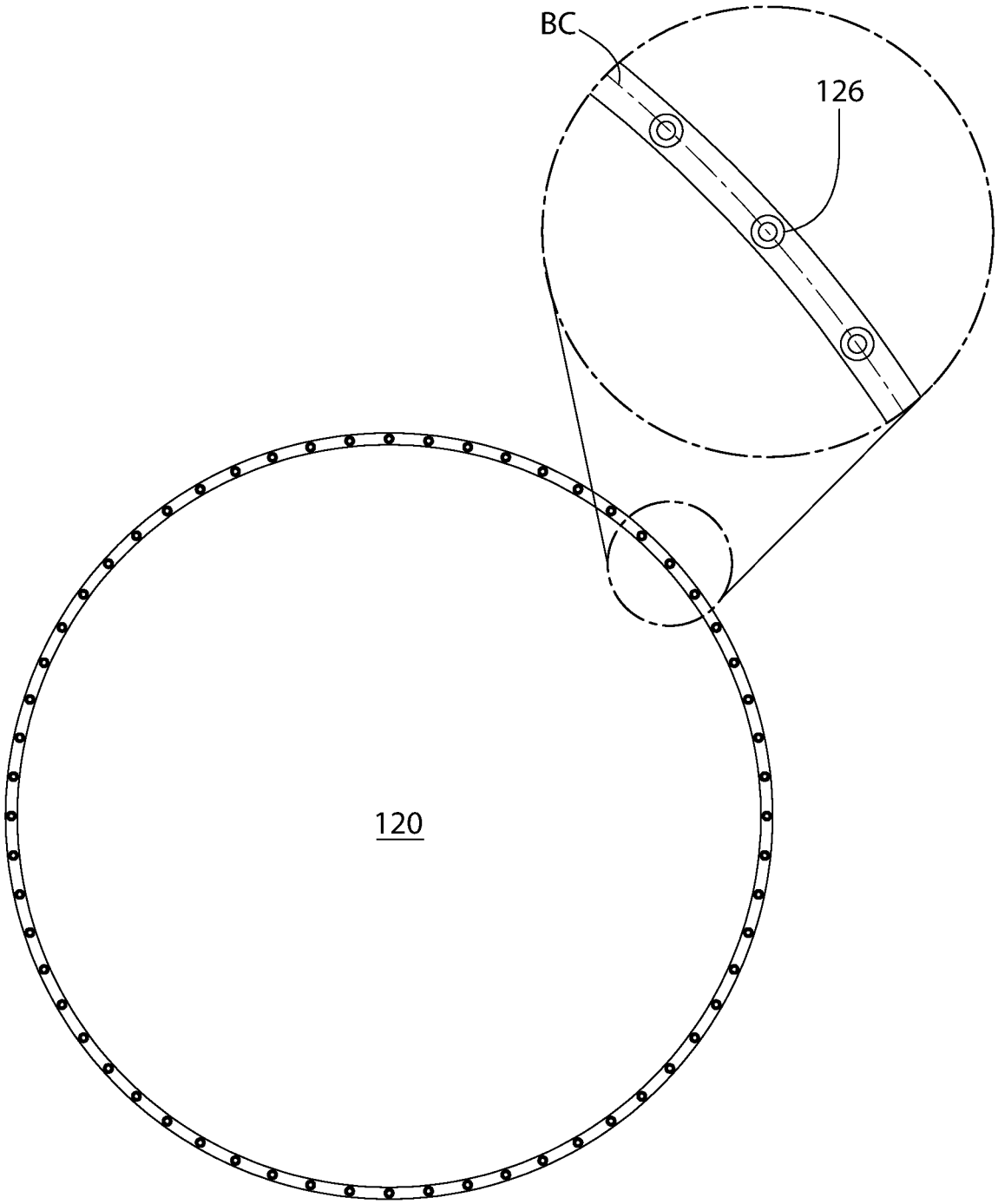
FIG. 9 is a top plan view of the canister.

All drawings are schematic and not necessarily to scale. Features shown numbered in certain figures are the same features which may appear un-numbered in other figures unless noted otherwise herein.

DETAILED DESCRIPTION

The features and benefits of the invention are illustrated and described herein by reference to exemplary embodiments. This description of exemplary embodiments is intended to be read in connection with the accompanying drawings, which are to be considered part of the entire written description. Accordingly, the disclosure expressly should not be limited to such exemplary embodiments illustrating some possible non-limiting combination of features that may exist alone or in other combinations of features.

In the description of embodiments disclosed herein, any reference to direction or orientation is merely intended for convenience of description and is not intended in any way to limit the scope of the present invention. Relative terms such as "lower," "upper," "horizontal," "vertical,", "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise.

As used throughout, any ranges disclosed herein are used as shorthand for describing each and every value that is within the range. Any value within the range can be selected as the terminus of the range. In addition, all references cited herein are hereby incorporated by reference in their entireties. In the event of a conflict in a definition in the present disclosure and that of a cited reference, the present disclosure controls.

FIG. 1 depicts a system for storing and transporting radioactive spent nuclear fuel (SNF) which incorporates a spent fuel canister 100 with compact bolted lid according to the present disclosure. The system generally includes an outer vertically ventilated overpack (VVO) or cask 20 defining a vertical longitudinal axis LA. Cask 20 may have a lid 21 and a composite construction including an outer cylindrical shell 22, inner cylindrical shell 23, and radiation shielding material 24 disposed in the annulus between the shells. In some embodiments, the shielding material 24 may comprise concrete, lead, boron-containing materials, or a combination of these or other materials effective to block and/or attenuate gamma and neutron radiation emitted by the SNF enclosed by the cask.

Cask 20 has an elongated body including an open top 27 for inserting canister 100 into cavity 28, a bottom end 25, cylindrical sidewall 29 extending between the ends, and an internal canister cavity 28 defined by the inner shell 23. Cavity 28 extends completely through the cask along the longitudinal axis LA from the top to bottom end. The cavity 28 has dimensions and a transverse cross-sectional area which holds only a single SNF canister 100 in one embodiment. Cask 20 includes an interior surface 23-1 adjacent to canister cavity 28 and opposing exterior surface 22-1. Cask 201 may be comprised of a single long cylinder body, or alternatively may be formed by a plurality of axially aligned and vertically stacked cylinder segments seal welded together at the joints between the segments to collectively form the cask body.

The bottom end 25 of cask 20 may be enclosed by circular base 26 attached thereto, such as via circumferential seal welding. A canister support pad 26-1 of cylindrical shape may be disposed on top of the base 26 inside canister cavity 28 to support the spent fuel canister 100. The pad may be formed of concrete in one embodiment. The cavity 28 of cask 20 may be ventilated by ambient cooling air to remove decay heat emitted by the SNF stored inside the canister 100. Cask 20 may therefore include one or more air inlets 30 communicating with a lower portion of cavity 28 and one or more air outlets 31 communicating with an upper portion of the cavity. Air flows radially inwards through inlets 30, upwards through the cavity, and radially outwards through outlets 31 (see directional airflow arrows). The open top end 27 of the cask 20 is closed by a removable lid detachably mounted to the cask. The outlet ducts 31 may be formed between the lid and top of the cask in some embodiments as shown.

FIGS. 1-14 depict spent fuel canister 100 with compact bolted lid according to a first embodiment of the present disclosure in further detail. The present canister advantageously comprises a bolted joint between the removable top closure lid and the canister body as previously described herein, thereby advantageously providing ready access to the SNF therein for repackaging or other purposes. The bolted lid joint is further described in the discussion which follows.

Canister 100 includes an elongated cylindrical body 103 comprising a single shell 106 including an open top 101, an open bottom 102, and sidewall 109 extending therebetween along a vertical longitudinal axis LA of the canister. Axis LA coincides with the geometric vertical centerline of the canister. Canister 100 further includes a bottom baseplate 110 and a top closure lid 120. Shell 106 may be of monolithic unitary structure in one embodiment formed of a single material.

Shell 106 further includes an inner surface 107 and opposing outer surface 108. A longitudinally-extending fuel cavity 105 extends between the top and bottom ends 101, 102 of the shell along longitudinal axis LA. Cavity 105 is configured to hold a conventional fuel basket 60 comprising a prismatic array of longitudinally-extending fuel storage cells 62. Cells 62 of the fuel basket may be defined by a cluster of elongated tubes 61 (shown), or alternatively interlocked cell dividers. Both designs are used and well known in the art without further elaboration necessary. The invention is not limited by the construction or configuration of the fuel basket used. The cells 62 are each configured for holding a single spent fuel assembly containing plural used or spent fuel rods removed from the reactor core. Such fuel assemblies are well known in the art without further elaboration. The spent fuel still emits considerable amounts of decay heat which is removed by the air-cooled ventilation system of the outer cask 20, as previously described herein.

Figure 19:
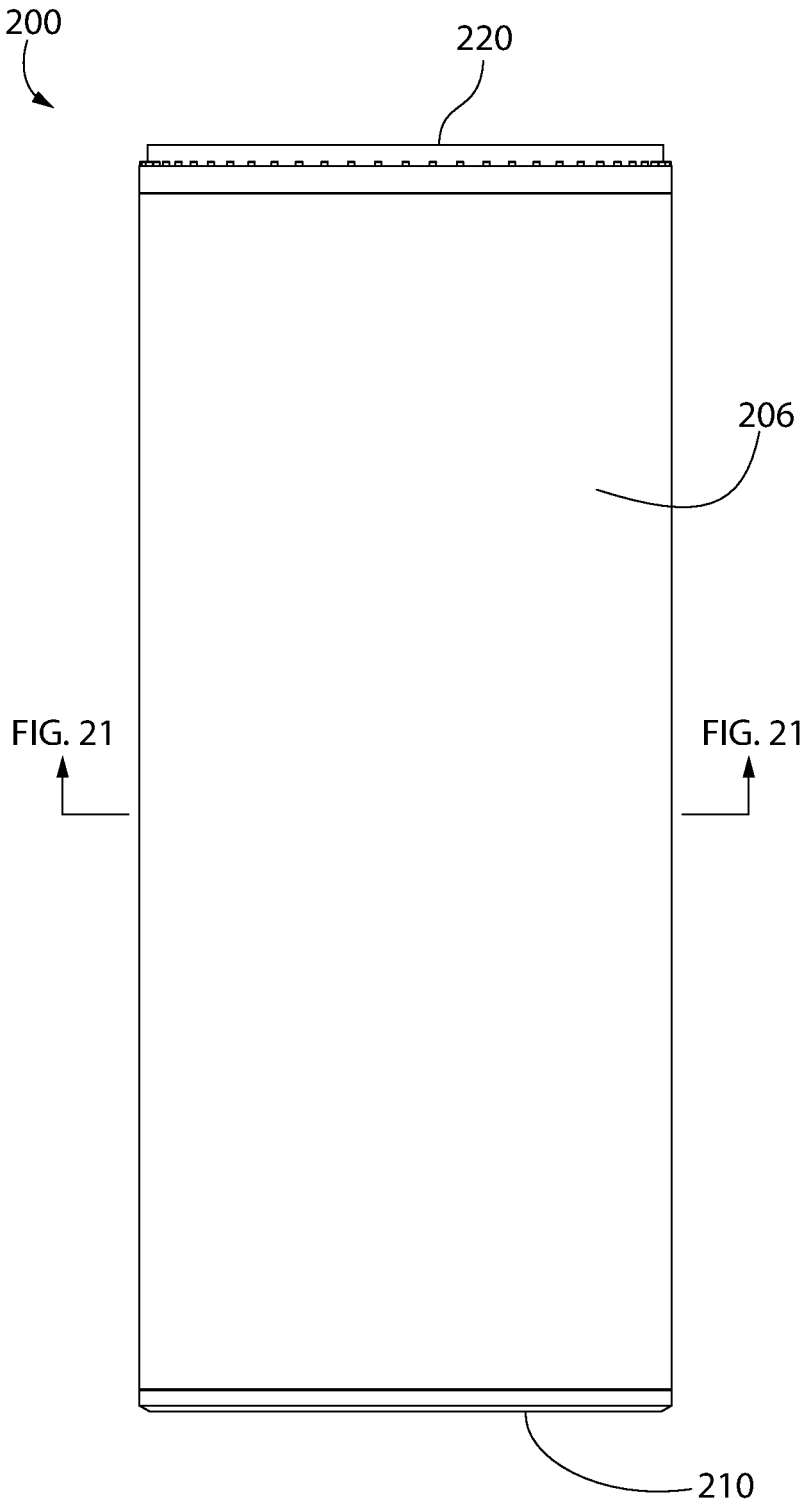
FIG. 19 is a side view of the second canister.
Figure 20:
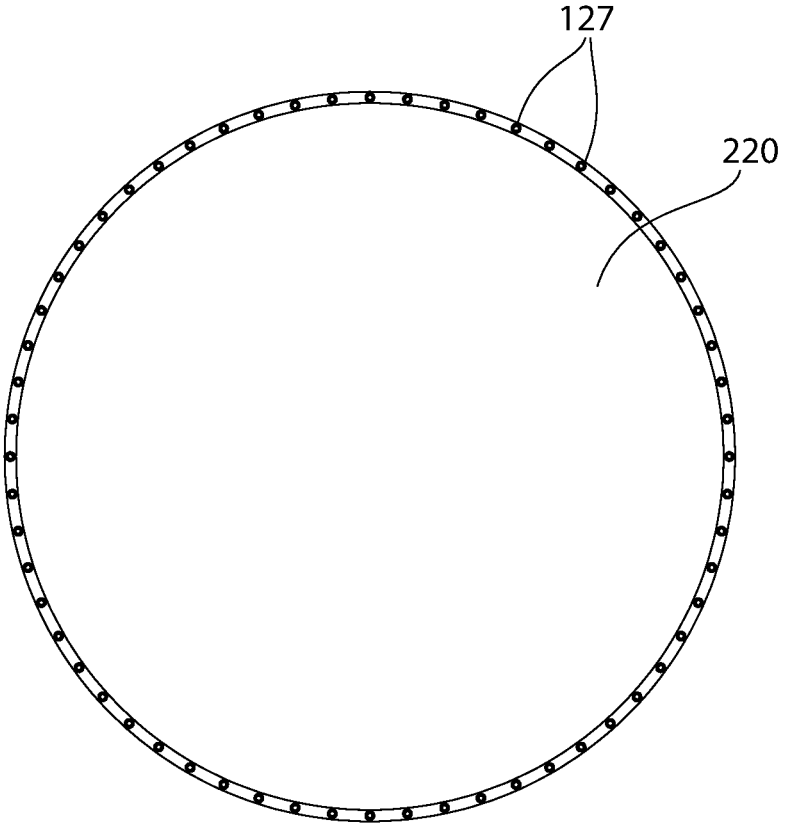
FIG. 20 is a top plan view of the second canister.
Figure 21:
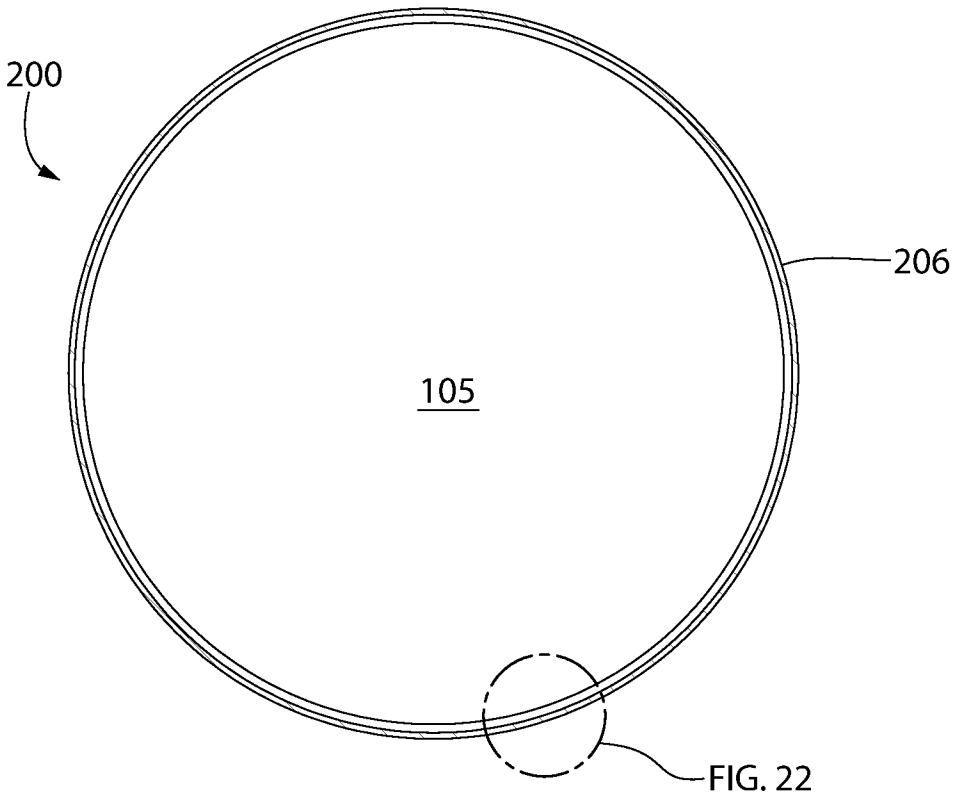
FIG. 21 is a transverse cross-sectional view taken from FIG. 19.
Figure 22:
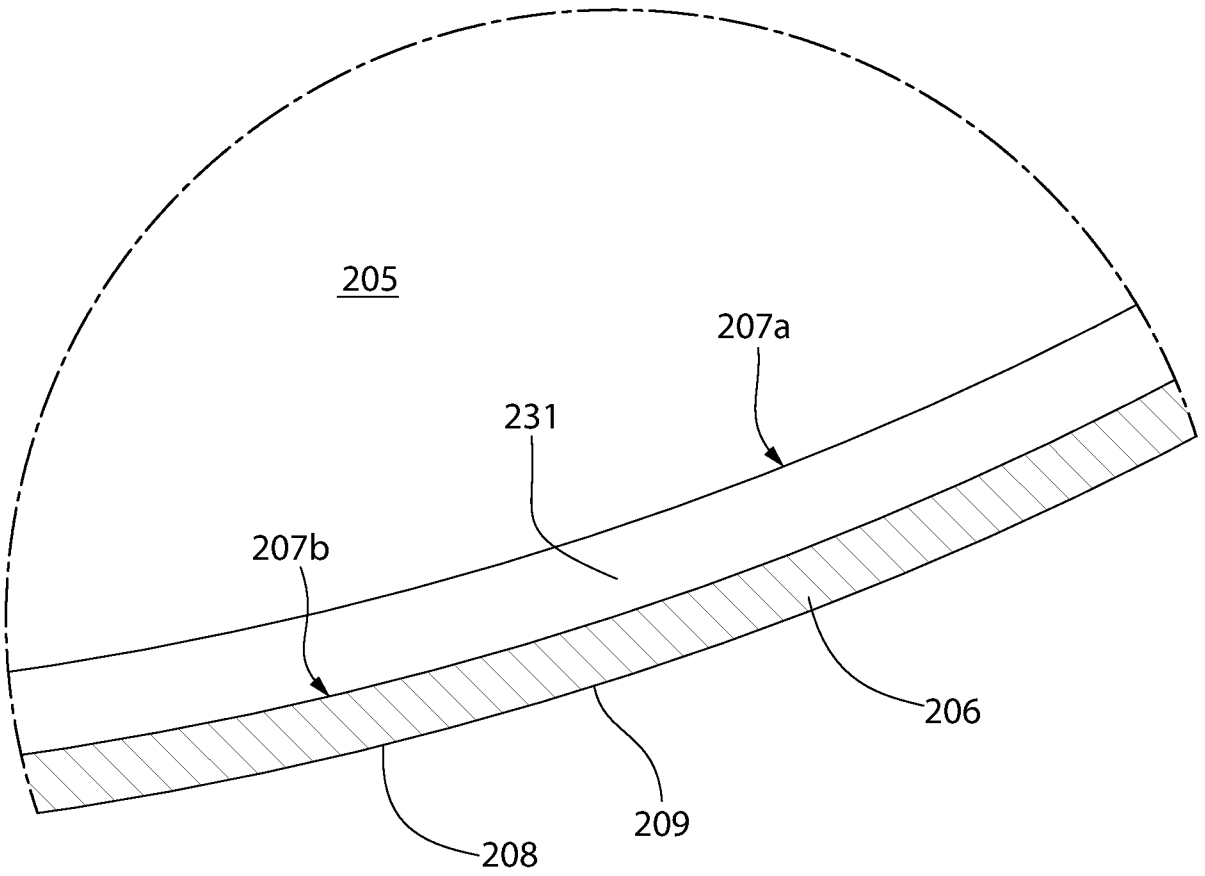
FIG. 22 is a detail view taken from FIG. 21.

The baseplate 110 is hermetically seal welded to the bottom end 102 of the shell 106. In one embodiment, the baseplate may have a larger diameter than bottom end of the shell such that the baseplate protrudes radially outwards beyond the shell (see, e.g. FIG. 10). This arrangement protects the longitudinal cooling fins 140 if provided, as further described herein. In other embodiments without fins, the baseplate 110 may have the same diameter as the bottom end of shell 106 such that the outward side surface of the baseplate is substantially flush with the outer surface 108 of the shell (see, e.g. FIG. 19).

Figure 10:
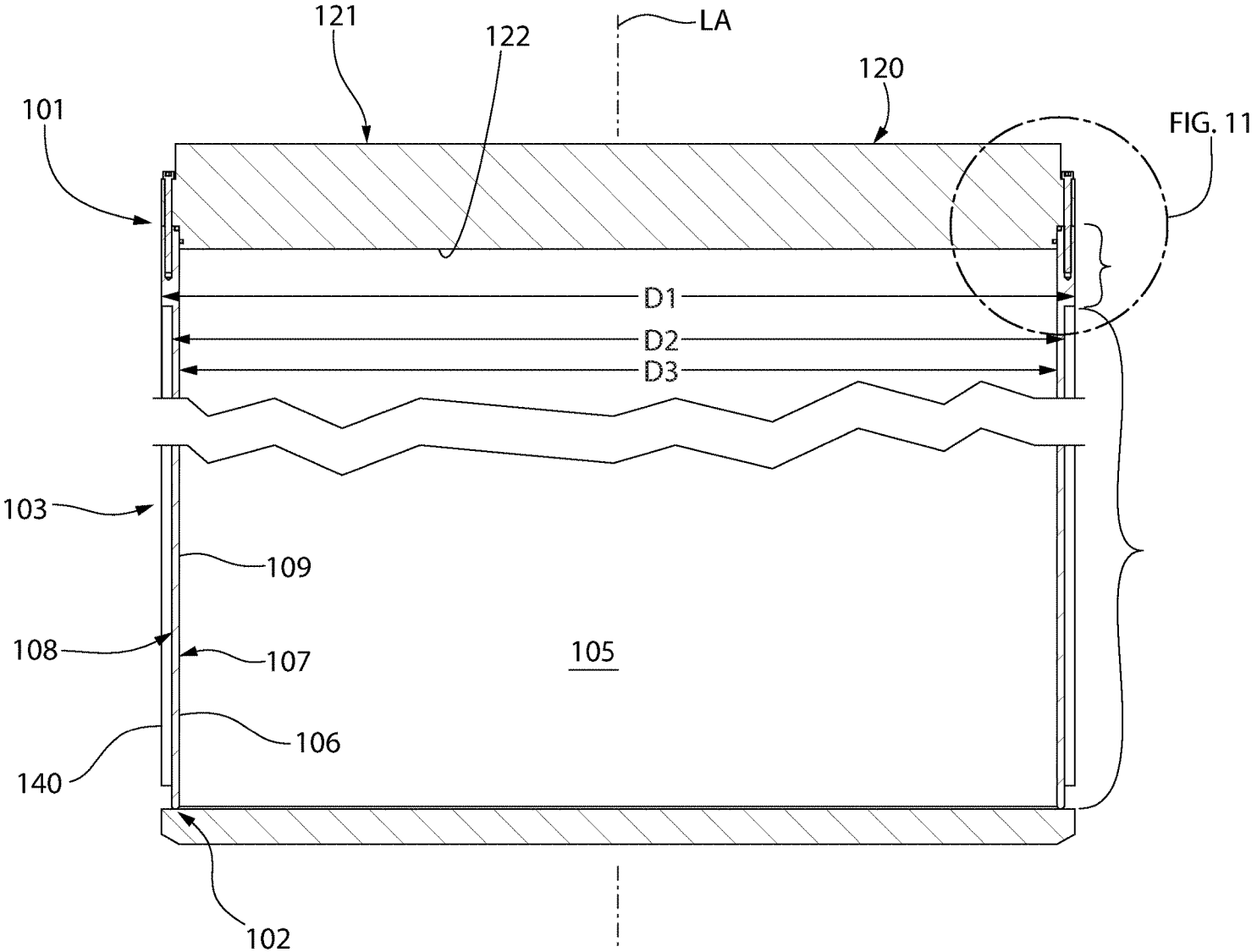
FIG. 10 is a side cross-sectional view of the canister.
Figure 11:
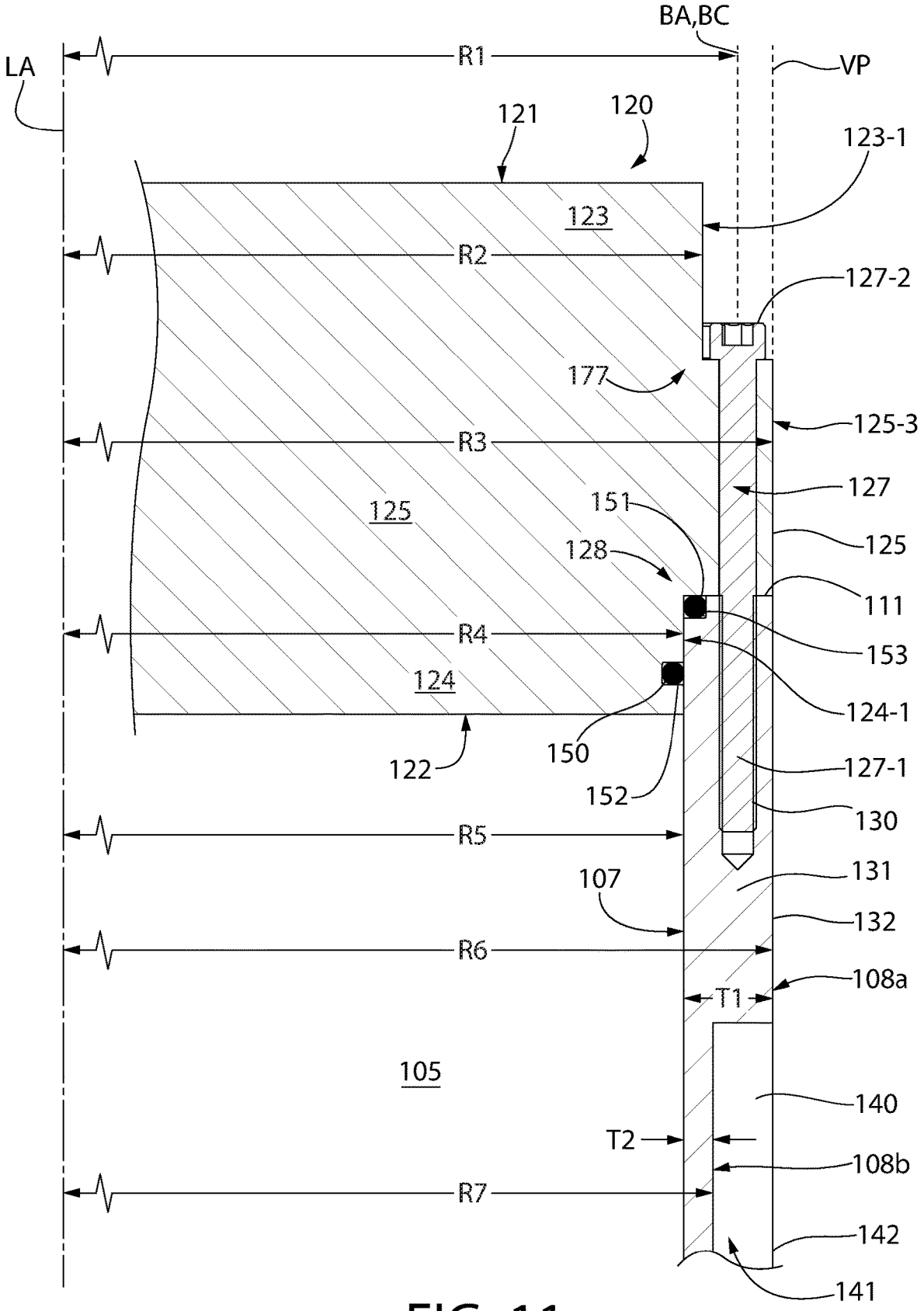
FIG. 11 is a detail view taken from FIG. 10.
Figure 12:
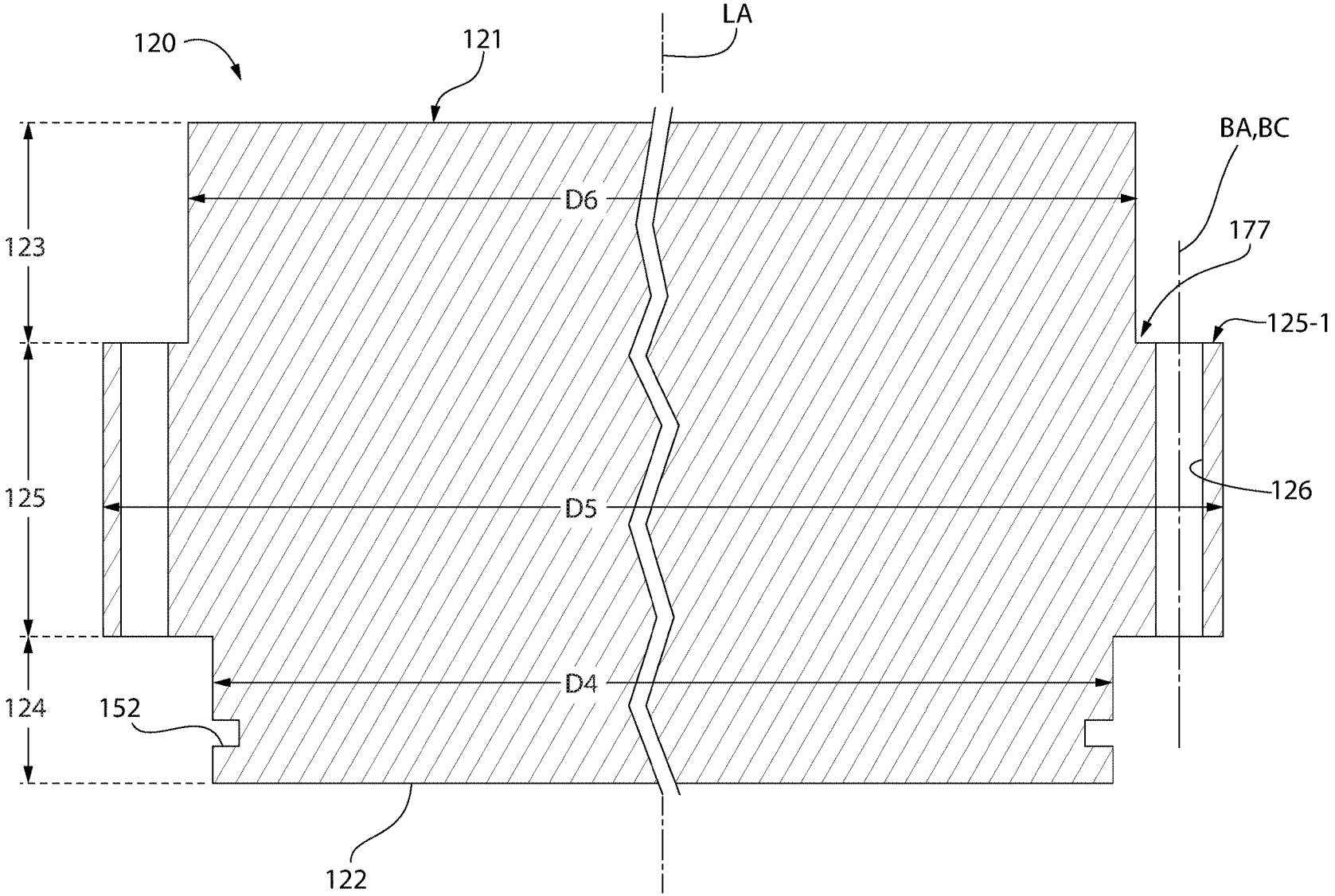
FIG. 12 is a side cross-sectional view of the lid of the canister.
Figure 13:
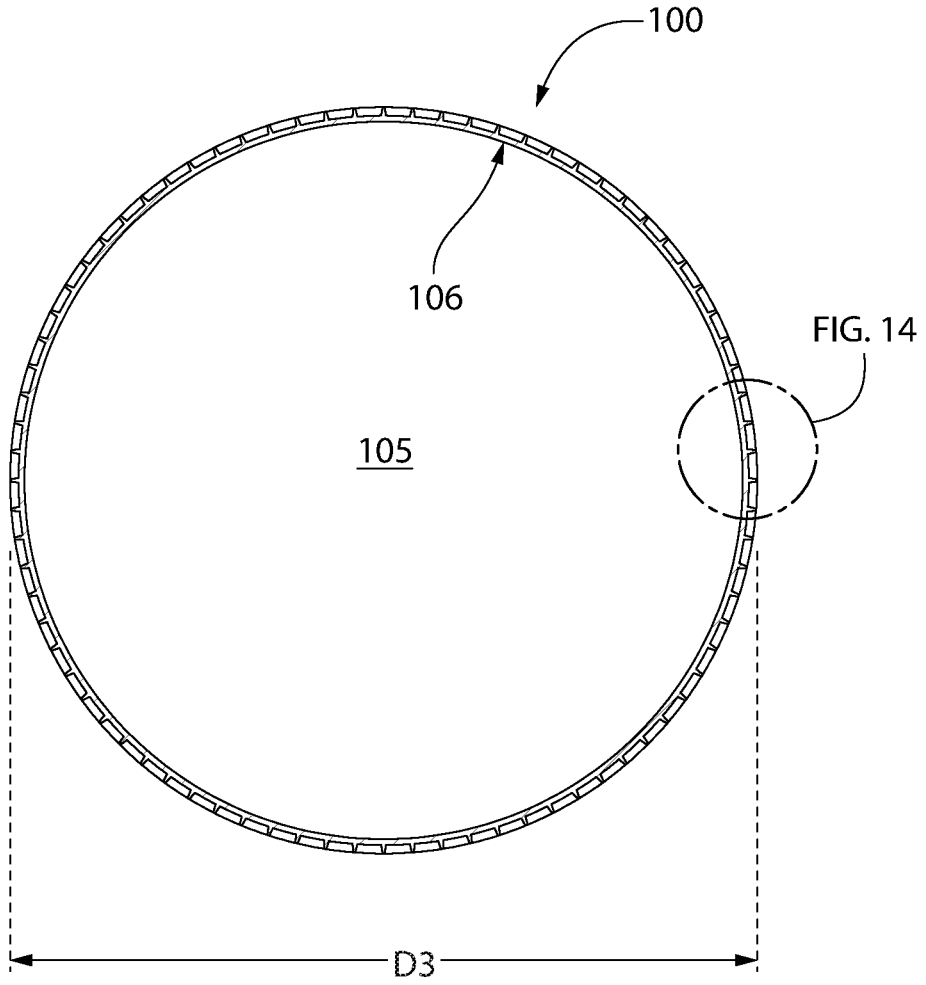
FIG. 13 is a transverse cross sectional view taken from FIG. 8.
Figure 14:
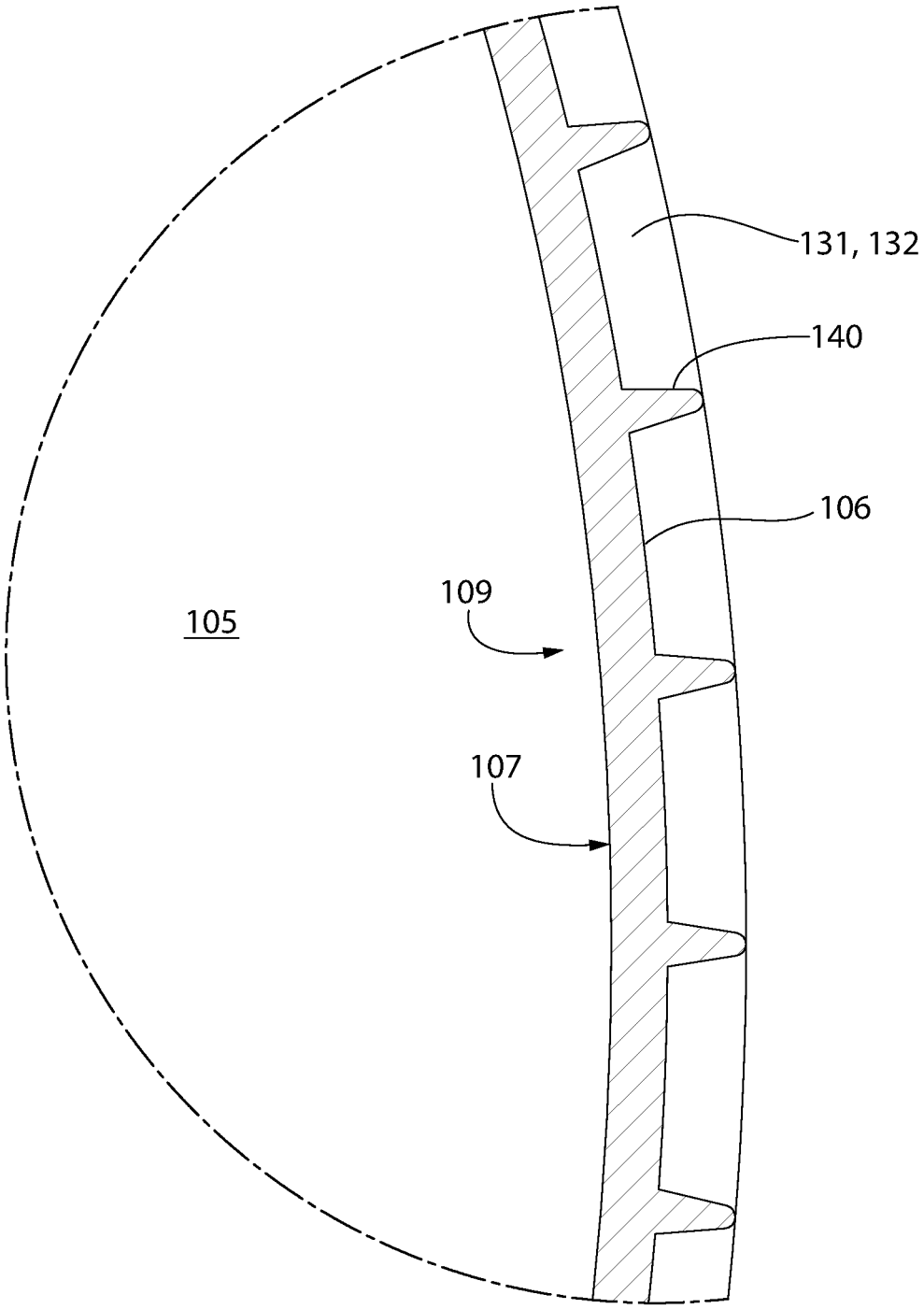
FIG. 14 is a detail view taken from FIG. 13.
Figure 15:
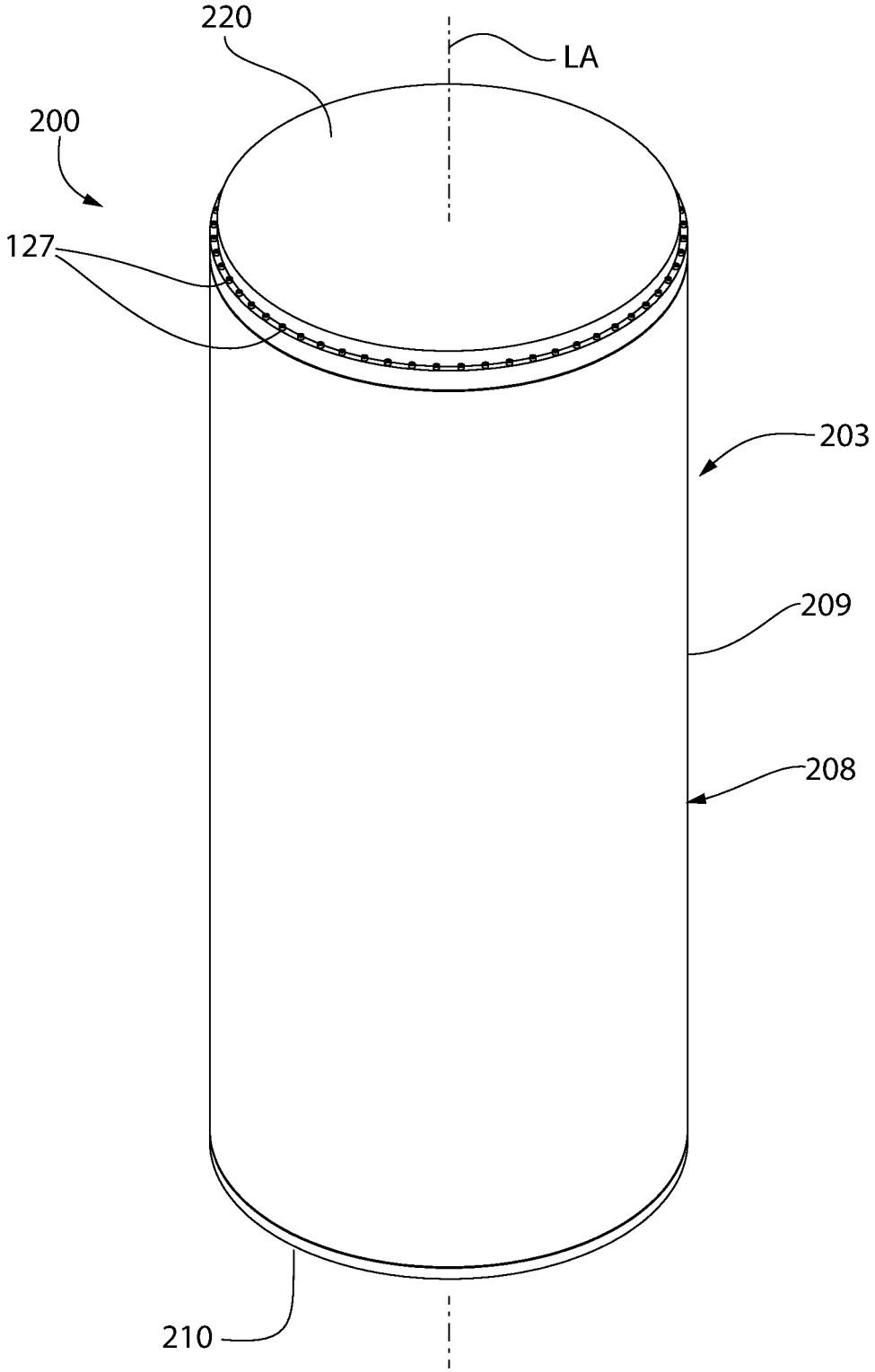
FIG. 15 is a top perspective view of a second embodiment of a canister and bolted lid.
Figure 16:
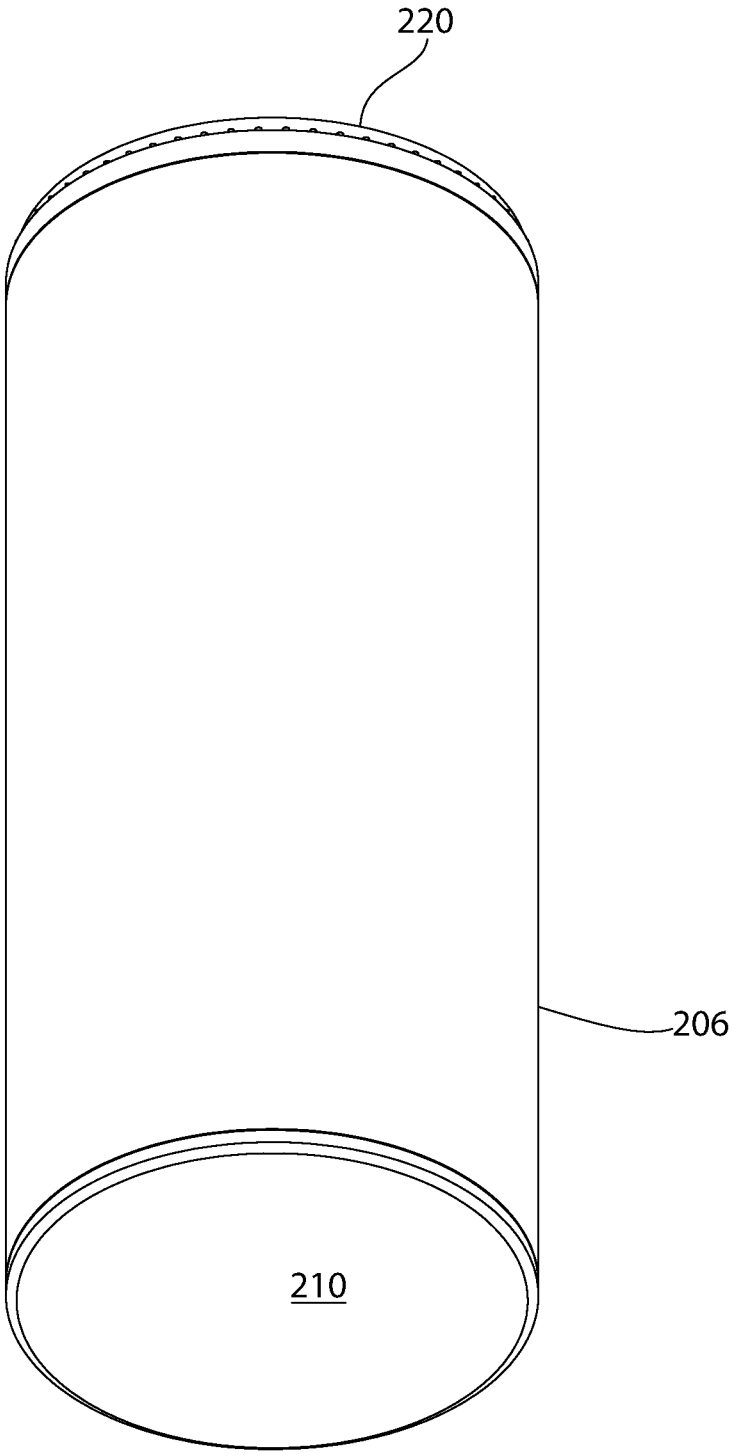
FIG. 16 is a bottom perspective view thereof.
Figure 17:
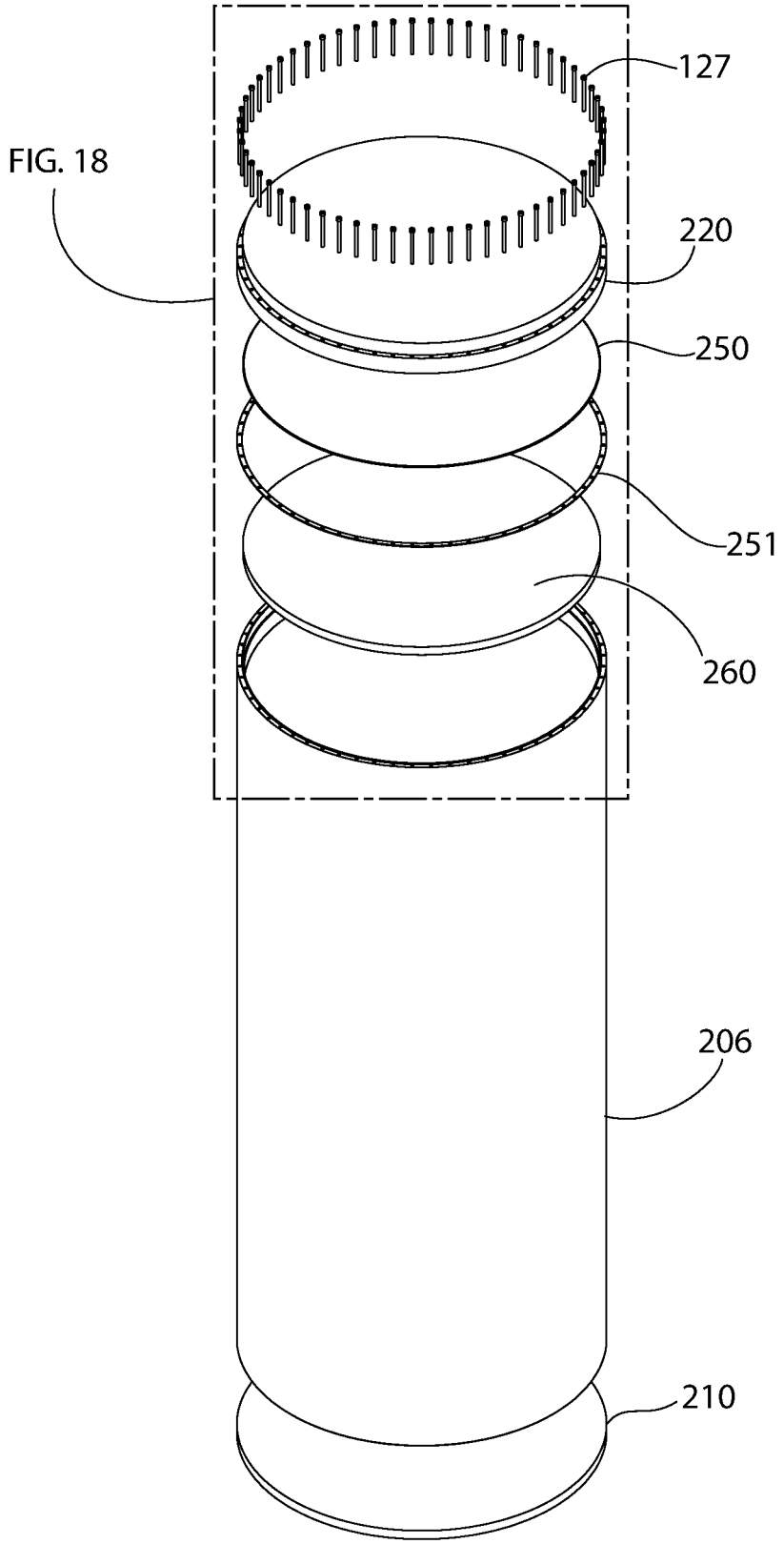
FIG. 17 is an exploded perspective view of the second canister.
Figure 18:
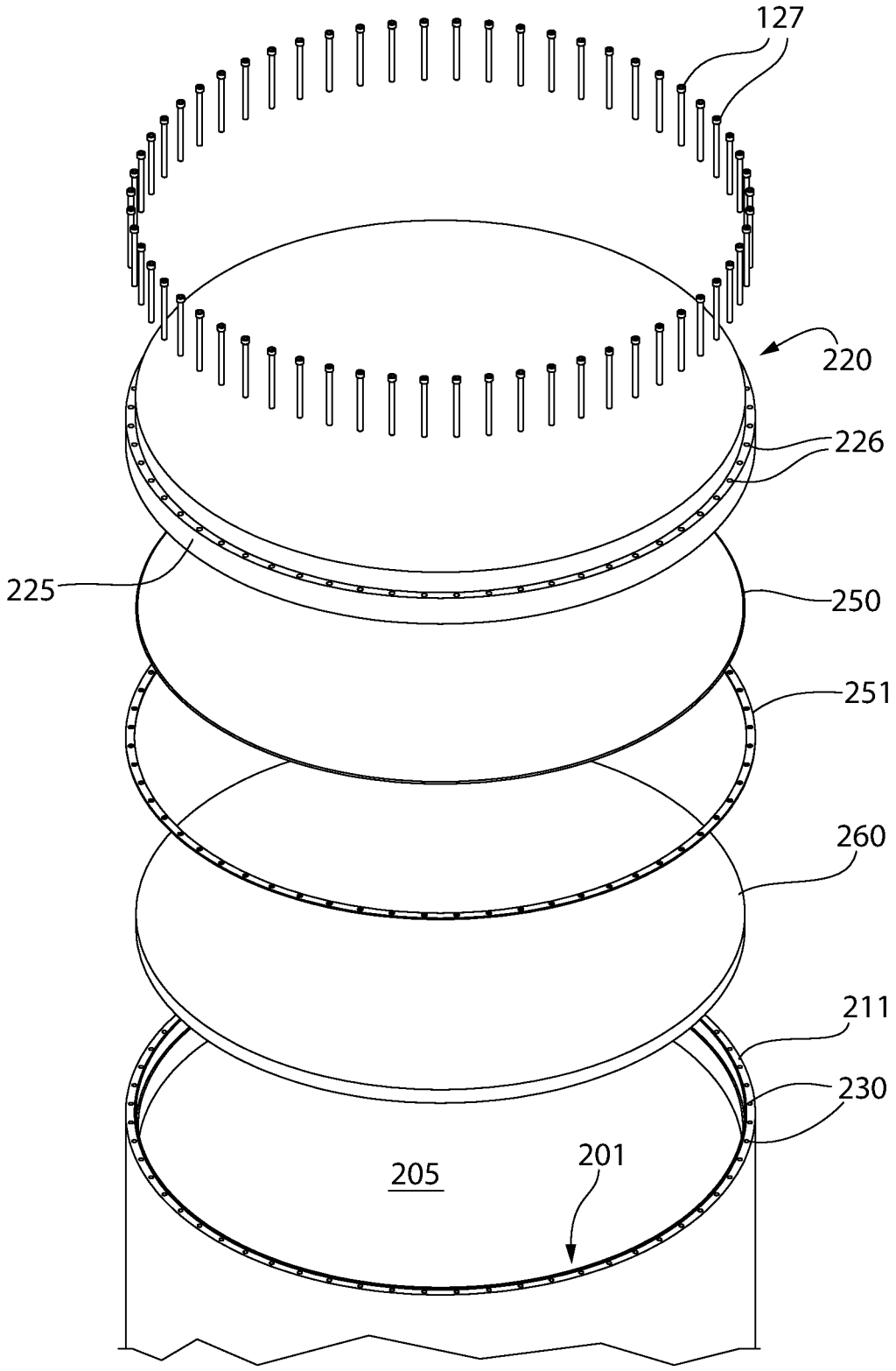
FIG. 18 is a detail view from FIG. 17.

The first embodiment of a top closure lid 120 variously seen in FIGS. 1-14 will now be described in greater detail. FIGS. 10-12 show the lid in larger detail.

Lid 120 may have a multi-stepped construction in one embodiment comprising a circular body including a top surface 121, bottom surface 122, an upper portion 123 adjacent the top surface, lower portion 124 adjacent the bottom surface, and an intermediate portion 125. Lower portion is configured for insertion into the upper portion of cavity 105 of canister shell 106 as shown. Accordingly, lower portion has an outside diameter D4 which is smaller than the inside diameter D3 of at least the top end 101 of shell 106 measured inside cavity 105.

Intermediate portion 125 protrudes radially outwards beyond the upper and lower portions 123, 124 and defines an upwardly and downwardly exposed portion thereby forming an annular mounting flange 125-1 which is part of the bolted lid-to-shell joint. The mounting flange has an outside diameter D5 which is larger than outside diameter D4 of lower portion 124 and inside diameter D3 of shell 106. Preferably, in one embodiment, diameter D5 is substantially the same as outside diameter D1 of the shell 106 measured proximate to the top end 101 of shell 106 such that flange 125-1 does not protrude substantially beyond the shell in the radial direction. This advantageously maintains the narrow profile and dimensions of the canister 100 which keeps the inside diameter of the outer overpack or cask 20 as smaller as possible. The canister thus has an overall and collective diameter (i.e. D5 and D1) commensurate with existing SNF canisters having seal welded lids. The underside (i.e. downward facing surface) of mounting flange 125-1 defines an annular sealing surface 125-2 configured to abut and seat on the top end of the shell when the lid is emplaced thereon (see, e.g. FIG. 11). The interface between the sealing surface 125-2 and top end 101 of shell 106 is preferably one of flat-to-flat.

Lid 120 further includes an annular step-shaped upper shoulder 177 at a transition between the intermediate mounting flange 125-1 and upper portion 123, and an annular step-shaped lower shoulder 128 at a transition between mounting flange and the lower portion 124. Lower shoulder 128 engages the inside edge of the top end of the shell 106 inside cavity 105 at to center the lid on the shell. Lower shoulder 128 further provides a sealing interface, as further described herein.

Mounting flange 125-1 comprises a plurality of longitudinal bolt through bores or holes 126 which extend completely through the flange. Bolt through holes 126 are configured for receiving the at least partially threaded shanks 127-1 of threaded fasteners which may be bolts 127 in one embodiment (see, e.g. FIGS. 10-12). Bolts 127 further have a diametrically enlarged tooling head 127-2 configured for engaging and applying a tool thereto to tighten or loosen the bolts. The underside of tooling heads 127-2 engage the upward facing surface of the mounting flange 125-1 (best shown in FIG. 11). Through holes 126 may be unthreaded in one preferred embodiment, but can be threaded in other embodiments. Top portion 123 may have any suitable outside diameter D6 which is smaller than diameter D5 of the intermediate portion 125/mounting flange 125-1 to provide access to the through holes 126 for inserting the bolts therethrough. The lid bolts preferably may be slender, for example about ½-inch diameter in some embodiments with long threaded length (e.g. at least 4 inches long). By using a greater number of smaller diameter slender bolts rather than few larger diameter bolts, the radial projection of the lid **1*q*20 may advantageously be kept to a minimum without adversely affecting the lid-to-shell hermetic seal and in turn minimizes the outside diameter of the canister 100**.

Bolt through holes 126 are arranged perimetrically around the mounting flange 125-1 and spaced circumferentially apart covering a full 360 degrees of the flange. Preferably, through holes 126 are uniformly spaced apart to provide even sealing pressure around the entire perimeter of the closure lid 120 when the bolts are tightened. The centerline of through holes 126 each defines a bolt axis BA. The plurality of through holes 126 collectively fall on and define a bolt circle BC intersecting bolt axes BA and extending circumferentially around the mounting flange 125-1.

The top end 101 of shell 106 comprises a plurality of perimetrically arranged and circumferentially spaced apart threaded sockets or bores 130 formed in the top end of the body of the shell 106. Bores 130 are vertically oriented and upwardly open for threadably receiving and engaging the threads on shanks 127-1 of bolts 127. Preferably, at least the lower portion of bolt shanks 127-1 are therefore threaded. Bores 130 are blind bores meaning the bottom ends of the bores are closed (see, e.g. FIG. 11). Bores 130 fall on the bolt circle BC and thus may each be coaxially aligned with a bolt axis BA of lid through holes 126 by proper rotational positioning of the lid on the shell. The bores 130 are formed between the inner surface 107 and upper outer surface **108*a* of shell 106 in the annular mounting boss 132 of the shell which defines top fastening portion 131**, as further described below.

To structurally reinforce the canister shell 106 for the bolting, the top end 101 of shell 106 is radially thickened to form an outwardly protruding annular mounting boss 132 integrally formed with the shell. Boss 132 extends around the entire circumference of the upper portion of the shell and vertically downwards from top end 101 of the shell 106. Boss 132 may be about 6 inches high in one non-limiting embodiment. The boss defines a top fastening portion 131 of the shell having a greater transverse wall thickness T1 (measured perpendicularly to longitudinal axis LA) than the wall thickness T2 of the portions of the shell below between the bottom end 102 of the shell and the fastening portion 131. This additional thickness provides extra purchase and structurally reinforces the top end of shell 106 for forming the threaded bores 130. In the illustrated embodiment, the annular mounting boss 132 may protrude radially outwards beyond the lower outer surface **108*b* of the lower portion of the shell 106 giving the shell a stepped outer surface 108. The lower outer surface 108*b* is thus recessed radially inwards from the upper outer surface 108*a* defined by the boss 132 such that outer surface 108*a* lies in a circular vertical plane which is offset and spaced farther away from the longitudinal axis LA of shell 106 than the lower outer surface 108*b* which lies in a different circular vertical plane (see, e.g. FIG. 11**).

It bears noting that the mounting boss 132/fastening portion 131 of the canister shell 106 is distinct from merely forming a conventional radially projecting flange on the top end of a shell used in bolted head flanged joints in which the shank of the fastener projects completely through mating flanges and a nut is threaded onto the bottom exposed shank portion. By contrast, the present mounting boss 132/fastening portion 131 of shell 106 is a substantially taller/higher thickened portion at the top end of the shell as shown in FIG. 11 which provides the important function of structurally reinforcing the shell for forming the threaded blind bores 130, not merely for accommodating a bolted lid-to-shell joint. Accordingly, embodiments of the present mounting boss 132/fastening portion 131 preferably have a height measured parallel to longitudinal axis LA which is greater than at least three times its radial/transverse wall thickness T1, and some embodiments greater than at least five times.

The radially offset between the upper outer surface 108*a* and lower outer surface 108*b* of the canister shell 106 defines an outwardly open annular recess 141 extending a full 360 degrees around the circumference of the shell in preferred embodiments. The annular recess extends from the bottom of the mounting boss 132 to the bottom baseplate 110.

According to another aspect of the invention, the canister 100 may comprise a plurality of longitudinally-extending cooling fins 140 protruding radially outwards from the shell. This provides additional cooling surface area for dissipating the heat emitted by the SNF stored in side canister 100. The fins are arranged perimetrically around the entire circumference of the shell 106 and spaced circumferentially apart, preferably at regular intervals with uniform spacing therebetween. The fins have a vertical length which extends for a majority of the vertical length of the shell to maximize the effective heat transfer area of the canister. Fins 140 may be formed integrally with the shell as a monolithic unitary structural portion thereof using a thick plate stock for the shell machined to form the fins. A typical plate stock may be 1¼-inch thick with machined rectangular fins ¾-inch high by ½-inch thick space at a 1¼-inch pitch around the circumference of the canister shell 106. Alternatively, the fins 140 may be discrete structures welded to the outer surface 108 of the shell 106. Fins 140 may be longitudinally straight structures including opposing side major surfaces and a straight vertical longitudinal edge as shown. In one embodiment, the fins 140 may have a wedge-shaped transverse cross section in which the side major surfaces converge moving radially outwards (best shown in FIG. 14). In other possible, embodiments, the side major surfaces may be parallel to each other. In one preferably arrangement, the fins 140 may be disposed on the lower outer surface 108*b* of shell 106 below the enlarged mounting boss 132-fastening portion 131 of the shell. Fins 140 extend vertically from the bottom of mounting boss 132 to the bottom baseplate 110 of the canister.

In one preferred but non-limiting arrangement, the cooling fins 140 may be completely disposed within the outwardly open annular recess 141 of the shell 106. This protects the fins from damage during handling and transport of the canister and advantageously maintain the desired small outside diameter of the canister 100 for storage in the outer radiation shielded cask 20. Accordingly, in this embodiment, fins 140 do not protrude radially outwards beyond the upper reinforced fastening portion 131 (i.e. boss 132) of the shell 106. The fins further may additionally not protrude radially beyond the mounting flange 125 of lid 120. And in some embodiments, the fins may further also not protrude radially beyond the baseplate 110 of the canister 100 to maximize protection of the fins from structural damage during handling of the canister and minimize the radial projection of the fins to maintain the small canister diameter.

In one embodiment, the top ends of the fins 140 may abut the underside (i.e. downward facing surface) of the annular boss 132 (see, e.g. FIG. 11), or alternatively terminate proximate thereto without contact. The opposite bottom ends of the fins 140 may terminate at a point proximate to but slightly spaced above the baseplate 110 to provide access for circumferentially seal welding the baseplate to bottom end 102 of the shell (see, e.g. FIGS. 5 and 10).

For canisters containing a moderate heat load, its finned surface may be sufficiently effective to keep the peak fuel cladding temperature of the SNF inside the canister moderate (defined as <300 degrees C.) and thus advantageously permit the use of a less expensive inert gas such as nitrogen in lieu of helium, as the fill gas in the canister.

Any suitable metallic materials may be used for constructing the lid 120, shell 106, plate 108, and fins 140. In one embodiment, stainless steel may be used for corrosion protection. Welding-friendly copper-nickel alloys and duplex stainless steel are also acceptable materials.

The longitudinal fin 140 arrangement discussed above applies to vertically stored canisters such as in the HI-STORM storage system available from Holtec International. In storage systems that employ horizontally oriented canisters, the direction of the fin on the shell must be circumferential (preferably, helical) to effect improvement in heat rejection. Circumferentially oriented fins can also be effectively utilized to eliminate hide-out crevices formed at the junction of the horizontal canister and rails that support it.

FIGS. 10 and 11 show the lid 120 fully seated, bolted, and sealed to the top fastening portion 131 of canister shell 106. The outer surface 125-3 of the mounting flange 125 of lid 120 does not project radially outwards beyond the upper outer surface 108*a* formed by the top fastening portion 131 defined by the annular mounting boss 132 of the shell. Accordingly, surfaces 125-3 and 108*a* lies in the same circular vertical plane Vp. The longitudinal edges 142 of cooling fins 140 occupying the annular recess 141 on the shell 106 do not protrude radially outwards beyond the top fastening portion 131 or lid 120; the edges also lying in the same vertical plane Vp. Each mounting bolt 127 passes vertically through its respective bolt through hole 126 in the intermediate mounting flange 125 of the lid and directly threadably engages the shell via the threaded bores 130 formed through the upward facing annular end surface 111 at the top end 101 of the shell.

In order to keep the outer diameter of the canister assembly to minimum for providing the desired compact small profile lid construction which emulates existing small profile welded rather than bolted canister lids for packaging in radiation shielded outer overpacks such as cask 20 previously described herein, special spatial relationships are created by the present lid as shown in FIG. 11. The radial distance R1 between the longitudinal axis LA of canister 100 and bolt axes BA/bolt circle BC is less than both the radial distance R6 between upper outer surface 108*a* of shell 106 and axis LA, and radial distance R3 between outer surface 125-3 of lid mounting flange 125 and axis LA. Radial distance R1 however is greater than radial distance R5 between axis LA and inner surface 107 of shell 106, and radial distance R4 between axis LA and outer surface 124-1 of lid lower portion 124 inside shell cavity 105. Radial distance R1 is also greater than radial distance R7 between axis LA and outer lower surface 108*b* of shell 106. Radial distance R2 between longitudinal axis LA and outer surface 123-1 of lid upper portion 123 is less than R1, R3, and R6, but greater than R4 and R5 in one embodiment. R2 may be substantially the same as R7 in one embodiment.

By keeping the outer diameter of the canister as small as possible, the outer transport/storage cask 20 dimensions are advantageously minimized which reduces fabrication costs and facilitates handling the large heavy casks with lifting equipment.

To seal the lid 120 to shell 106, a pair of circumferential seals is provided including an annular inner seal 150 and annular outer seal 151. Inner seal 150 seals the lower portion 124 of the lid to the inner surface 107 of shell 106. A piston type seal arrangement may be provided as shown comprising an outward facing annular piston groove 152 formed in the outer surface 124-1 of lid lower portion 124 in which inner seal 150 is retained. When the lid 120 is placed on the top fastening portion 131 of the shell, the smaller diameter lid lower portion 124 is inserted into inside the upper portion of shell cavity 105. Inner seal 150 slides down along the inner surface 107 of the shell until the lid is fully seated on the canister.

The circumferential outer seal 151 seals the step-shaped lower shoulder 128 of lid 120 to the top annular end surface 108 of the shell 106. An annular groove 153 is formed at the innermost corner edge of end surface 108 which retains the outer seal 151. The inner and outer seals 150, 151 provide two independent high integrity leak barriers advantageously creating redundant protection against leakage of gaseous matter from inside the canister 100. Any suitable annular seals may be used. In one embodiment, the seals may be O-rings formed of a suitable sealing material such as without limitation flexible elastomeric materials.

FIGS. 15-25 depict a spent nuclear fuel (SNF) canister 200 with compact bolted lid according to a second embodiment of the present disclosure in further detail. SNF canister 200 is similar to canister 100. Similar parts will not be described in detail or numbered in the figures for the sake of brevity. There are some notable differences in design. For example, the shell 206 of canister 200 is substantially similar to shell 106 of canister 100 with exception that is does not have a step-shaped outer surface with annular recess. Instead, the inner surface of the shell is step shaped as further described below. In addition, canister 200 may be finless as shown, or alternatively may be equipped with external cooling fins if heat emitted by the SNF is considerable. Top closure lid 220 has a different configuration than lid 120 of canister 100; however, it retains the small profile bolted joint to the canister shell as further described below. In addition, lid 220 of canister 200 has a different sealing arrangement.

Referring now to FIGS. 15-25, canister 200 includes an elongated cylindrical body 203 comprising a single shell 206 including an open top 201, an open bottom 202, and sidewall 209 extending therebetween along a vertical longitudinal axis LA of the canister. Axis LA coincides with the geometric vertical centerline of the canister. Canister 200 further includes a bottom baseplate 210 and a top closure lid 220. In this finless embodiment of a shell 206, the baseplate preferably does not protrudes radially outwards beyond the lower portion of the shell to keep the outside diameter of the canister to a minimum for placement inside the outer radiation shielded overpack or cask 20. Shell 206 may be of monolithic unitary structure in one embodiment formed of a single material.

Shell 206 further includes an inner surface 207 and opposing outer surface 208. A longitudinally-extending fuel cavity 205 extends between the top and bottom ends 201, 202 of the shell along longitudinal axis LA. Cavity 205 is similarly configured to that of canister 100 to hold a conventional fuel basket 60 comprising a prismatic array of longitudinally-extending fuel storage cells 62, as previously described herein.

To structurally reinforce the canister shell 206 for the bolting, the top end 201 of shell 206 is radially thickened but in an inwards direction creates a uniform outer surface 208 but a step-shaped inner surface 207. This is dissimilar to shell 106 of canister 100 previously described herein which is radially thickened in an outward direction. Shell 206 therefore comprises an inwardly protruding annular mounting boss 232 integrally formed with the shell 206 at its top end 201. Boss 206 extends around the entire circumference of the upper portion of the shell. The boss defines top fastening portion 231 of the shell 206 having a greater transverse wall thickness T3 than the wall thickness T4 of the portions of the shell below between the bottom end 202 of the shell and the fastening portion 231. A plurality of upwardly open threaded bores 230 similar to bores 130 previously described herein are arranged and spaced circumferentially around the top end 201 of shell 206. Bores 230 penetrate upward facing annular end surface 211 of the shell.

Figure 23:
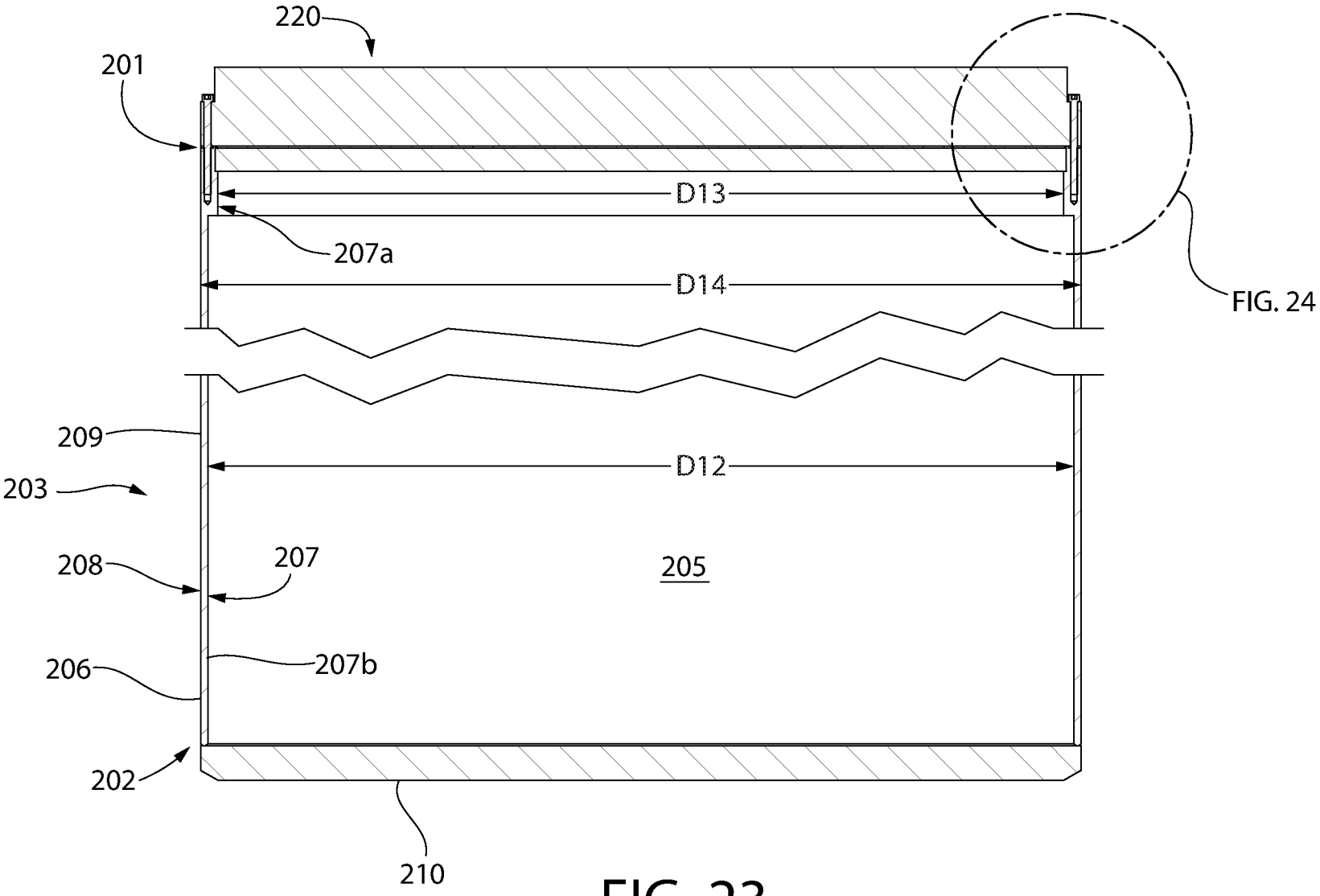
FIG. 23 is a side cross-sectional view of the second canister.
Figure 24:
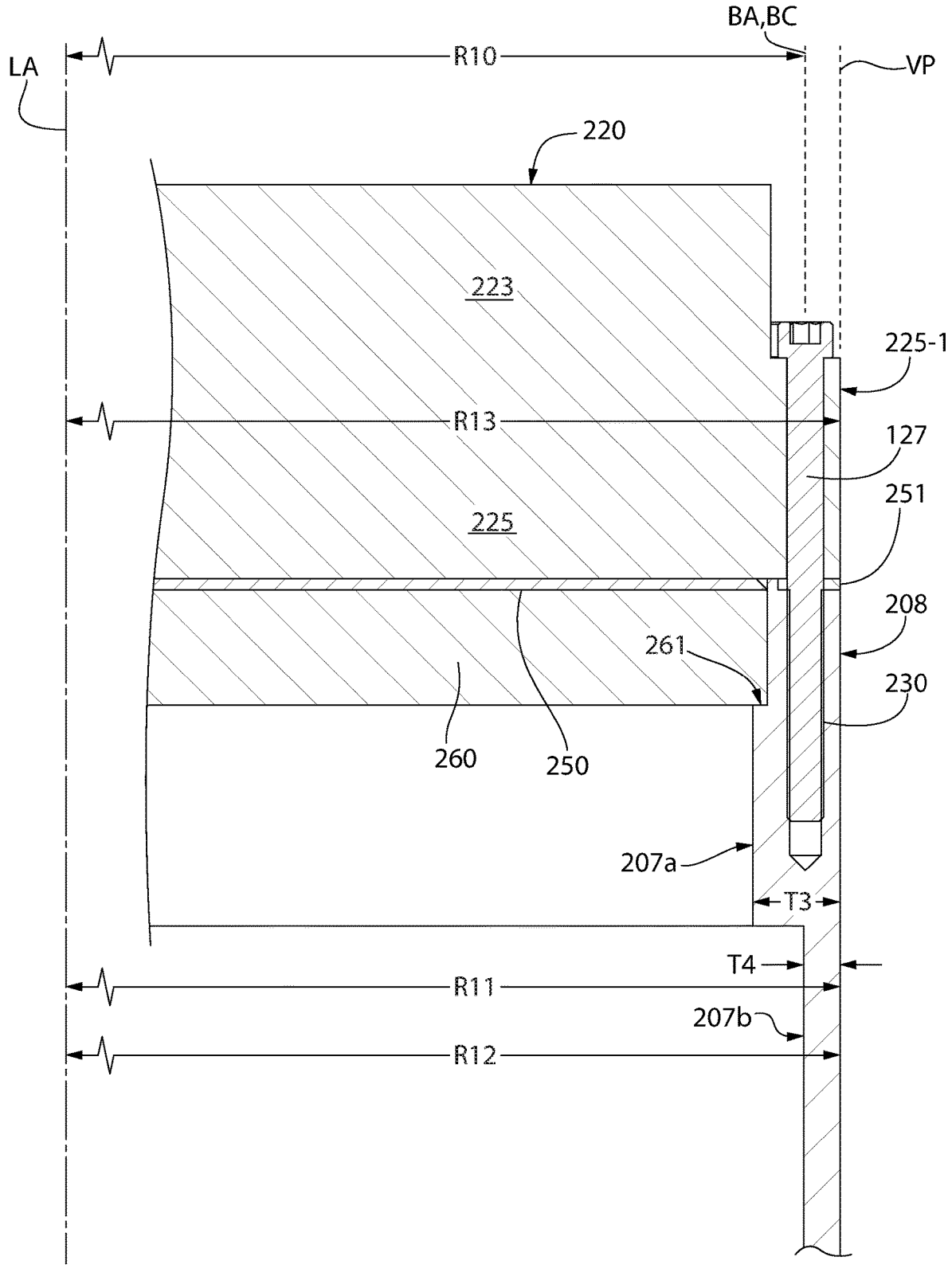
FIG. 24 is a detail view taken from FIG. 23.
Figure 25:
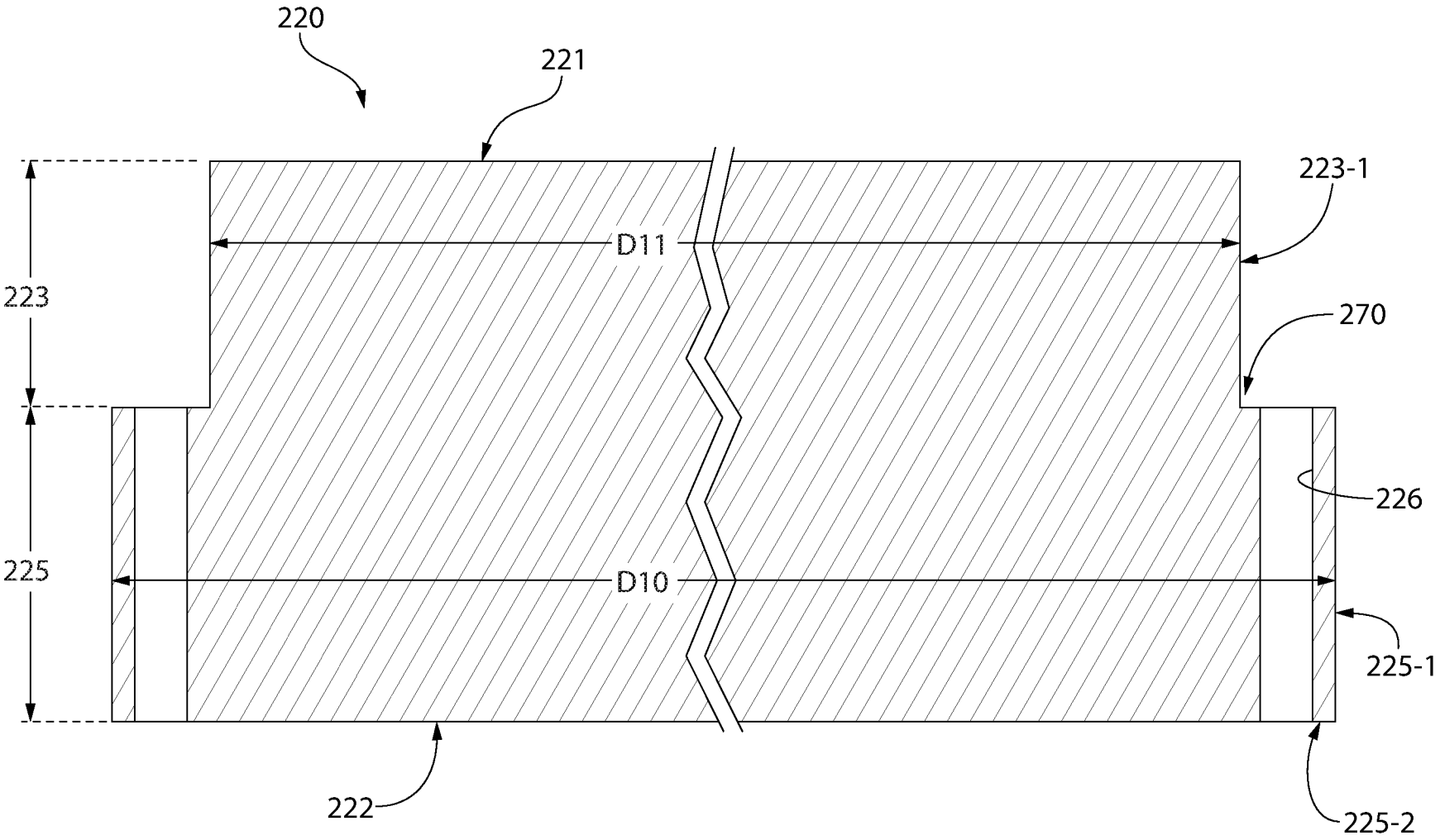
FIG. 25 is a side cross sectional view of the lid of the second canister.

Referring particularly to FIGS. 23-25, the present lid 220 may have a stepped construction in one embodiment comprising a circular body including a top surface 221, bottom surface 222, an upper portion 223 adjacent the top surface, and a lower portion defining a radially protruding annular mounting flange 225 which is part of the bolted lid-to-shell joint. 124 adjacent the bottom surface, and in immediate portion 125. The mounting flange has an outside diameter D10 which is larger than outside diameter D11 of upper portion 223 of lower portion 124 and inside diameter D13 at the fastening portion 232 of shell 106. An annular step 270 is formed between the upper portion and mounting flange. Preferably, in one embodiment, diameter D10 is substantially the same as outside diameter D14 of the shell 206 such that flange 225 does not protrude substantially outwards beyond the shell in the radial direction. This advantageously maintains the narrow profile and dimensions of the canister 200 which keeps the inside diameter of the outer overpack or cask 20 as smaller as possible. The canister thus has an overall and collective diameter (i.e. D11 and D14) commensurate with existing SNF canisters having seal welded lids. The underside (i.e. downward facing surface) of mounting flange 225 defines an annular sealing surface 225-2 configured for positioning on the top end surface 211 of the shell when the lid is emplaced thereon (see, e.g. FIG. 24). The interface between the sealing surface 225-2 and end surface 211 is preferably one of flat-to-flat for accommodating annular outer seal 251. Seal 251 may be a planar self-energizing or raised face gasket in one embodiment that forms the outermost secondary confinement barrier to prevent gaseous products from leaking from the canister cavity 205 to the outer environment. Any suitable metallic or non-metallic seal material may be used.

In the present lid 220 design, it bears noting that no portion of the lid protrudes downwards into the top portion of the canister cavity 205 in contrast to lid 120 previously described herein. Instead, a circular disk-shaped shield plate 260 is provided which sits immediately down and inside the top end of the cavity 205 as shown in FIGS. 23-24. The circumferential peripheral edge of the shield plate 260 is supported by an upward facing annular support surface 261 defined by an annular step-shaped shoulder formed in the upper inner surface 207*a* of shell 206 proximate to its top end 201, but spaced vertically downward therefrom as shown. The support surface 261 is thus formed in the radially thickened upper fastening portion 232 of the shell. Shield plate 260 forms part of the primary containment boundary of the canister 200. The shield plate may be sealed by an inner seal which may comprise a circular disk-shaped diaphragm seal 250 disposed between the shield and bottom surface 222 of the lid 200. Both the shield plate and diaphragm seal may be formed of a suitable metallic material, such as stainless steel in one embodiment.

Canister 200 further includes Lid 120 further includes an annular step-shaped upper shoulder 127 at a transition between the intermediate mounting flange 1254 and upper portion 123, and an annular step-shaped lower shoulder 128 at a transition between mounting flange and the lower portion 124. Lower shoulder 128 engages the inside edge of the top end of the shell 106 inside cavity 105 at to center the lid on the shell. Lower shoulder 128 further provides a sealing interface, as further described herein.

Mounting flange 125-1 comprises a plurality of longitudinal bolt through bores or holes 126 which extend completely through the flange. Bolt through holes 126 are configured for receiving the at least partially threaded shanks 127-1 of threaded fasteners which may be bolts 127 in one embodiment (see, e.g. FIGS. 10-12). Bolts 127 further have a diametrically enlarged tooling head 127-2 configured for engaging and applying a tool thereto to tighten or loosen the bolts. The underside of tooling heads 127-2 engage the upward facing surface of the mounting flange 125-1 (best shown in FIG. 11). Through holes 126 may be unthreaded in one preferred embodiment, but can be threaded in other embodiments. Top portion 123 may have any suitable outside diameter D6 which is smaller than diameter D5 of the intermediate portion 125/mounting flange 125-1 to provide access to the through holes 126 for inserting the bolts therethrough.

FIGS. 23 and 24 shows the lid 220 fully seated, bolted, and sealed to the top fastening portion 232 of canister shell 106. The outer surface 225-1 of the mounting flange 225 of lid 220 does not project radially outwards beyond the outer surface 108 formed by the top fastening portion 231 defined by the annular mounting boss 232 of the shell. Accordingly, surfaces 125-1 and 208 lie in the same circular vertical plane Vp. Each mounting bolt 127 passes vertically through its respective bolt through hole 226 in the mounting flange 225 of the lid and directly threadably engages the shell via the threaded bores 230 formed through the upward facing annular end surface 211 at the top end 201 of the shell. Shield plate 260 is recessed in the top end 201 of shell 206 inside cavity 205 such that the top surface of the shield plate does not protrude upwards beyond the top end 201 of the shell. The inner diaphragm seal 250 lies in the same horizontal sealing plane as the outer annular seal 251.

Special spatial relationships are created by the present lid 220 as shown in FIG. 24 to maintain the compact lid and canister profiles. The radial distance R10 between the longitudinal axis LA of canister 200 and bolt axes BA/bolt circle BC is less than both the radial distance R11 between outer surface 208 of shell 206 and axis LA, and radial distance R13 between outer surface 225-1 of lid mounting flange 225 and axis LA. R13 and R11 may be substantially the same providing a flush lid to shell transition and outer surfaces. Radial distance Radial distance R10 may be substantially the same are radial distance R12 between axis LA and the lower inner surface 207*b* of shell 206.

While the foregoing description and drawings represent some example systems, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes described herein may be made. One skilled in the art will further appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims and equivalents thereof, and not limited to the foregoing description or embodiments. Rather, the appended claims should be construed broadly, to include other variants and embodiments of the invention, which may be made by those skilled in the art without departing from the scope and range of equivalents of the invention.

What is claimed is:

1. A canister for spent nuclear fuel storage comprising:

a longitudinal axis;

an elongated shell extending along the longitudinal axis, the shell including a top end and a bottom end;

a cavity extending along the longitudinal axis inside the shell for storing spent nuclear fuel;

a baseplate attached to the bottom end of shell and enclosing a lower portion of the cavity;

a closure lid detachably fastened to the top end of the shell and enclosing an upper portion of the cavity;

a plurality of mounting bolts extending longitudinally through the lid and threadably engaging the top end of the shell; wherein the canister is configured for placement inside an outer overpack with radiation shielding; and wherein the lid has a circular lid body comprising a lower portion inserted into the cavity of the shell, an upper portion, and an intermediate annular mounting flange protruding radially outwards beyond the lower and upper portions, the bolts extending longitudinally through respective vertical bolt holes in the mounting flange to engage the top of the shell.

2. The canister according to claim 1, wherein the mounting flange does not protrude radially outwards beyond the top of the shell.

3. The canister according to claim 1, wherein the lid includes an annular step-shaped upper shoulder at a transition between the mounting flange and upper portion, and an annular step-shaped lower shoulder at a transition between mounting flange and the lower portion.

4. The canister according to claim 1, further comprising an upper circumferential seal disposed at an interface between the upper shoulder and the top of the shell, and a lower circumferential seal disposed at an interface between the lower portion and the shell.

5. The canister according to claim 1, wherein the lid body has a monolithic unitary construction which includes the upper portion, the lower portion, and the mounting flange.

6. The canister according to claim 1, wherein the lid is hermetically seal welded to the top of the shell and does not protrude radially outwards beyond the top of the shell.

7. The canister according to claim 1, wherein the bolts each define a bolt axis which is spaced by a first radial distance from the longitudinal axis of the canister which is less than a second radial distance between an outer surface of the shell and the longitudinal axis.

8. The canister according to claim 1, wherein the bolts each threadably engage a corresponding upwardly open threaded bore formed in the top of the shell.

9. The canister according to claim 8, wherein the threaded bores penetrate an upward facing annular end surface of the top of the shell.

10. The canister according to claim 9, when the bolts are arranged in a circumferentially and uniformly spaced apart bolt pattern extending a full 360 degrees around the annular end surface of the top of the shell.

11. The canister according to claim 8, wherein the fastening portion has a greater first wall thickness than a second wall thickness of the lower portion of the shell between the fastening portion and the bottom end of the shell, and the fastening portion having a height greater than at least three times its first wall thickness.

12. The canister according to claim 11, wherein the fastening portion protrudes radially outwards beyond the lower portions of the shells and defines an outwardly open recessed area extending longitudinally between the fastening portion and the baseplate of the canister.

13. The canister according to claim 12, further comprising a plurality of longitudinally-extending cooling fins protruding radially outwards from the shell in the recess.

14. The canister according to claim 13, wherein the fins do not protrude radially outwards beyond the upper reinforced fastening portion of the shell.

15. The canister according to claim 11, wherein the baseplate protrudes radially outwards beyond the lower portion of the shell.

16. A canister for spent nuclear fuel storage comprising:

a cylindrical shell extending along the longitudinal axis, the shell including a top end, a bottom end, and an outer surface;

an internal cavity extending between the top and bottom ends of the shell along the longitudinal axis for storing spent nuclear fuel;

a baseplate attached to the bottom end of shell and enclosing a lower portion of the cavity;

a closure lid detachably fastened to the top end of the shell and enclosing an upper portion of the cavity, the lid having a circular body comprising a first upper portion and a second mounting flange portion protruding radially outwards beyond the first upper portion;

a plurality of mounting bolts extending longitudinally through the second mounting flange portion of the lid and threadably engaging the top end of the shell; wherein the second mounting flange portion of the lid does not protrude radially outwards beyond the outer surface of the shell;

wherein the canister is configured for placement inside an outer overpack with radiation shielding; and wherein the lid further comprises a third lower portion inserted into the cavity of the shell, the second mounting flange portion protruding radially outwards beyond the third lower portion.

17. The canister according to claim 16, wherein the bolts each threadably engage a corresponding upwardly open threaded bore formed in the top of the shell.

18. The canister according to claim 16, further comprising an annular circumferential seal disposed at an interface between an upward facing annular end surface of the top of the shell and a downward facing annular surface defined by the mounting flange portion of the lid.

19. The canister according to claim 18, further comprising a circular radiation shield plate received in an upper portion of the cavity and supported therein by the shell, the shield plate disposed between the mounting flange portion of the lid and the cavity.

20. The canister according to claim 19, further comprising a circular diaphragm seal interspersed between the shield plate and the mounting flange portion of the lid.

21. The canister according to claim 16, further comprising a plurality of longitudinally-extending cooling fins protruding radially outwards from the shell, the fins spaced perimetrically apart around the shell.

22. The canister according to claim 21, wherein the fins do not protrude radially beyond the lid of the canister.

23. The canister according to claim 22, wherein the fins do not protrude radially beyond the baseplate of the canister.

* * * * *